US006805164B2

(12) United States Patent
Stouffer

(10) Patent No.: US 6,805,164 B2
(45) Date of Patent: Oct. 19, 2004

(54) MEANS FOR GENERATING OSCILLATING FLUID JETS HAVING SPECIFIED FLOW PATTERNS

(75) Inventor: Ronald D. Stouffer, Silver Springs, MD (US)

(73) Assignee: Bowles Fluidics Corporation, Columbia, MD (US)

( * ) Notice: Subject to any disclaimer, the term of this patent is extended or adjusted under 35 U.S.C. 154(b) by 24 days.

(21) Appl. No.: 10/309,490

(22) Filed: Dec. 4, 2002

(65) Prior Publication Data

US 2003/0127142 A1 Jul. 10, 2003

Related U.S. Application Data

(60) Provisional application No. 60/336,960, filed on Dec. 4, 2001.

(51) Int. Cl.[7] ..... F15C 1/06
(52) U.S. Cl. ..... 137/833; 137/826; 137/806
(58) Field of Search ..... 137/806, 826, 137/833, 14

(56) References Cited

U.S. PATENT DOCUMENTS 3,437,099 A * 4/1969 Griffin, Jr. ..... 137/826
3,448,752 A * 6/1969 O'Neill ..... 137/826
3,586,024 A * 6/1971 Tuzson et al. ..... 137/826

* cited by examiner

*Primary Examiner*—A. Michael Chambers
(74) *Attorney, Agent, or Firm*—Larry J. Guffey

(57) ABSTRACT

A fluidic oscillator capable of generating free fluid jets having distinctive, controllable and industrially/commercially useful flow patterns has a switching chamber having an inlet port that allows a pressurized fluid to enter and flow through the oscillator, an exhaust passage having a sidewall that forms one boundary wall of the switching chamber, a container passage having a sidewall that forms the second boundary wall of the switching chamber, a compliance member connected to the distal end of the container passage, and an expansion chamber connected to the distal end of the exhaust passage, with the expansion chamber having an exhaust orifice that allows fluid to flow from the oscillator. In operation, such an oscillator yields a contained fluid jet that issues from the inlet port into the swishing chamber and alternately switches its flow direction between the container and exhaust passages. This switching action serves to generate controllable pressure waves in the exhaust passage and expansion chamber which act to control the pattern of the free fluid jet that flows from the orifice.

21 Claims, 28 Drawing Sheets

U.S. PATENT NO. 4,052,002

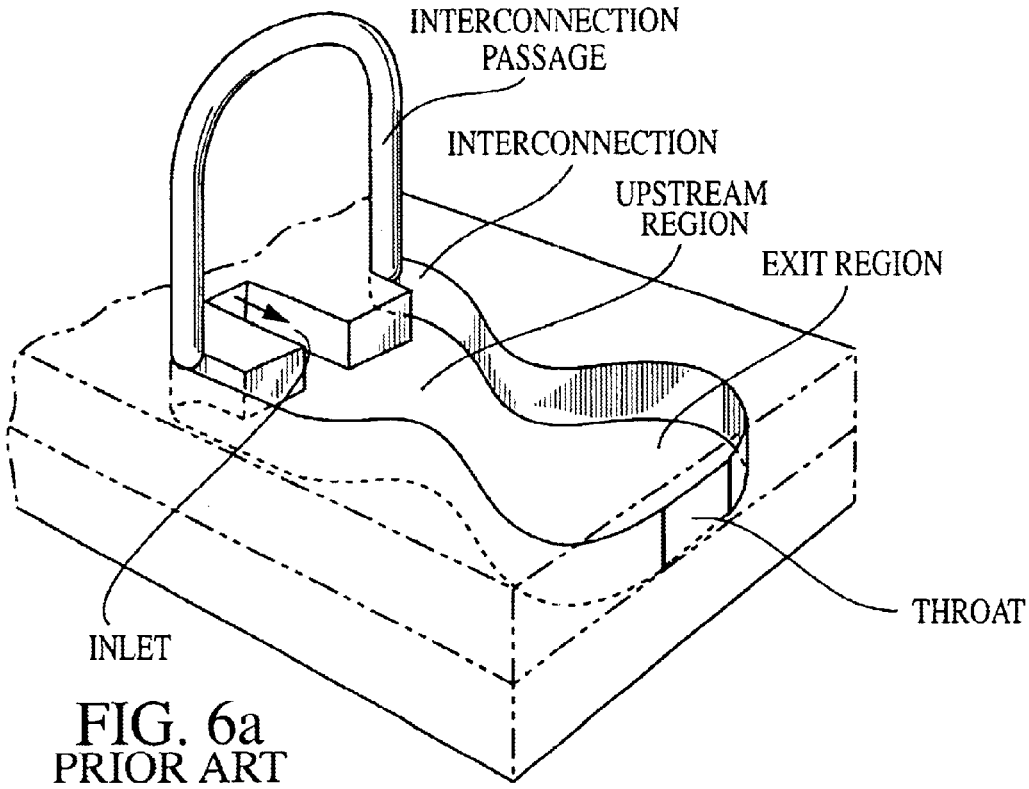
FIG. 6a
PRIOR ART
FIG. 6b
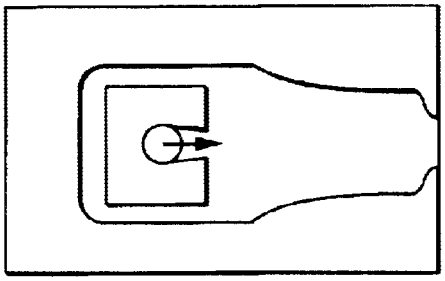
FIG. 6c
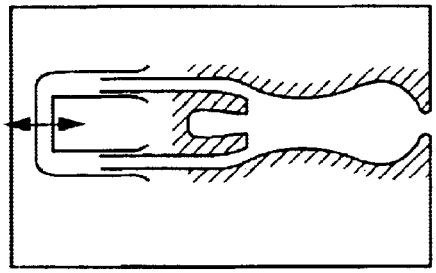

00452
P=16 psi
L=4 in
D=.5 in

00453
P=16 psi
L=4 in
D=.3 in

00454
P=16 psi
L=4 in
D=.25 in

00455
P=16 psi
L=4 in
D=.20 in

00456
P=16 psi
L=4 in
D=.17 in

00457
P=16 psi
L=3 in
D=0.5 in

00458
P=16 psi
L=3 in
D=0.3 in

00459
P=16 psi
L=3 in
D=0.25 in

00460
P=16 psi
L=3 in
D=0.2 in

00462
P=16 psi
L=2 in
D=0.5 in

00463
P=16 psi
L=2 in
D=0.3 in

00464
P=16 psi
L=2 in
D=0.25 in

00465
P=16 psi
L=2 in
D=0.2 in

00466
P=16 psi
L=1 in
D=0.3 in

00467
P=16 psi
L=1 in
D=0.25 in

00468
P=16 psi
L=1 in
D=0.2 in

00469
P=16 psi
L=1.5 in
D=0.3 in

00470
P=16 psi
L=1.5 in
D=0.25 in

P=16 psi
L=4 in
OUTLET - ANNULAR ORIFICE

MEANS FOR GENERATING OSCILLATING FLUID JETS HAVING SPECIFIED FLOW PATTERNS

CROSS REFERENCE TO RELATED APPLICATION

This application claims the benefit of Provisional Patent Application No. 60/336,960, filed Dec. 4, 2001 by Ronald D. Stouffer.

BACKGROUND OF THE INVENTION

1. Field of the Invention

This invention relates to fluid handling processes and apparatus. More particularly, this invention relates to methods and apparatus for effecting controlled dispersal of fluid to achieve specific flow patterns. Such flow patterns are of interest in a wide range of applications (e.g., shower and sink sprays, spas that provide fluid massaging actions, drying equipment).

2. Description of the Related Art

Fluidic oscillators are well known in the prior art for their ability to provide a wide range of liquid spray patterns by cyclically deflecting a liquid jet. Examples of fluidic oscillators may be found in many patents, including U.S. Pat. Nos. 3,185,166 (Horton & Bowles), 3,563,462 (Bauer), 4,052,002 (Stouffer & Bray), 4,151,955 (Stouffer), 4,157,161 (Bauer), 4,231,519 (Stouffer), which was reissued as RE 33,158, 4,508,267 (Stouffer), 5,035,361 (Stouffer), 5,213,269 (Srinath), 5,971,301 (Stouffer), 6,186,409 (Srinath) and 6,253,782 (Raghu). The technology disclosed is these patents is summarized below.

However, before reviewing these patents, it is perhaps informative to make note of some of the distinct features of fluidic oscillators. The operation of most fluidic oscillators is usually characterized by the cyclic deflection of a fluid jet without the use of mechanical moving parts. Consequently, an advantage of fluidic oscillators is that they are not subject to the wear and tear which adversely affects the reliability and operation of pneumatic oscillators and reciprocating nozzles.

The fluidic oscillators described in U.S. Pat. No. 3,185,166 (Horton & Bowles) are characterized by the use of boundary layer attachment (i.e., the "Coanda effect," which is named after Henri Coanda who was the first to explain the tendency for a jet issuing from an orifice to defect from its normal path so as to attach to a nearby sidewall) and the use of downstream feedback passages which serve to cause the jet issuing from a power nozzle to oscillate between exiting in either the right or left side ports. See FIG. 1 which shows the top view of a two dimensional fluidic which, as is conventional in fluidic technology, is assumed to have a transparent top surface so as to reveal the internal geometry of the fluidic.

This fluidic is symmetric about its longitudinal centerline L—L and consists of an interaction region with sidewalls which diverge downstream from a power nozzle. A jet issued by the power nozzle is cyclically deflected back and forth between the interaction region sidewalls by a portion of the jet which is captured at a feedback passage inlet and fed back to effect deflection.

The feedback force exerted by the feedback passages must not only be sufficient to deflect the jet itself, but it must also overcome the boundary layer attachment of the jet to a sidewall. The result is that the oscillator cannot operate at jet pressures below a rather significant pressure level.

Moreover, the attachment of the jet to the sidewalls during each half cycle of oscillation results in a "dwell" time wherein the jet is effectively stationary. The spray pattern produced by the cyclically deflected jet, which alternately exits through one or the other of the exit ports at the top of the oscillator, consequently contains greater concentrations of jet fluid at those pattern locations corresponding to the effective stationary state of the jet (i.e., the outer edges of the spray distribution pattern), rather than at other locations. It is therefore not possible to control pattern distribution or to achieve uniformly distributed patterns, with oscillators of this type. Furthermore, the use of porous plugs in the control tubes were seen to result in even longer duration jet "dwell" times on the sidewalls.

It should be recognized that the three-dimensional character of the flow from such fluidics can take a variety of forms depending upon the three-dimensional shape of the fluidic. For example, if the depth of the fluidic shown in FIG. 1 is approximately the same as the width of its exit ports, then an approximate, oscillating round jet with be sprayed from the fluidic. If the depth of the fluidic is much greater than the width of the exit port, then an oscillating, sheet of fluid will exit from the fluidic. If the fluidic is such that it has angular symmetry about its centerline, it's exit port will be annular in shape and from it will spray an oscillating, annular ring of fluid.

The fluidic oscillators described in U.S. Pat. No. 3,563,462 (Bauer) are characterized by what is sometimes called a flow-reversing, interaction region which results in the flow from this fluidic's power nozzle to have a bistable flow pattern. The use of downstream feedback passages, which connect at points downstream from the fluidic's power nozzle, serves to cause the flow to oscillate between exiting from the right and left side ports. See FIG. 2. The sidewalls of the flow-reversing interaction region first diverge from the power nozzle and then converge toward an outlet throat in a downstream direction. When the jet flows along the left sidewall it is re-directed thereby toward the right as it egresses through the outlet throat; likewise, the right sidewall re-directs the jet toward the left. The entry of ambient fluid into the interaction region via the outlet throat is relatively restricted as compared to the Horton & Bowles oscillator, primarily because the outlet throat is narrower relative to the egressing jet than the downstream end of the Horton & Bowles oscillator. The limitation of ambient fluid entry reduces the boundary layer attachment to the interaction region sidewalls so that less feedback force is required to deflect the jet. Oscillation in the flow-reversing configuration is therefore possible at lower jet pressures than in the Horton & Bowles oscillator. When a liquid issues from the power nozzle into an ambient air environment, such oscillators with flow-reversing interaction regions display relatively low frequency oscilliations and have found numerous practical applications, such as in shower heads, lawn sprinklers, decorative fountains, industrial control equipments, etc.

The spray pattern produced by this type of oscillator is often nonuniform due to ambient air being ingested through the feedback passages and randomly mixed with issuing primary jet liquid. In addition, since a mixture of air and liquid has a different viscosity than the liquid alone, and since the size of the droplets exiting from this type of oscillator are a function of the viscosity of the resulting fluid spray, the sprays from these oscillators are often found to have considerable variability in droplet sizes.

The fluidic oscillators described in U.S. Pat. No. 4,052,002 (Stouffer & Bray) are characterized by the selection of the dimensions of the fluidic such that no ambient fluid or primary jet fluid is ingested back into the fluidic's interaction region. See FIGS. 3(*a*)–3(*b*). This yields a spray pattern that is more uniform and with a spray that is made up of droplets of more uniform size.

The absence of inflow or ingestion from outlet region is achieved by creating a static pressure at the upstream end of interaction region which is higher than the static pressure in outlet region. This pressure difference is created by a combination of factors, including: the width T of the exhaust throat is only slightly wider than power nozzle so that the egressing power jet fully seals interaction region from outlet region; and the length D of interaction region from power nozzle to throat, which length is significantly shorter than in prior art oscillators. It should be noted that the width X of control passages is smaller than the power nozzle. If the width of power nozzle at its narrowest point is W, then the following relationships were found to be suitable, although not necessarily exclusive, for operation in the manner described: T=1.1–2.5 W and D=4–9 W, with the ratios of these dimensions also being found to control the fan angle over which the fluid is sprayed.

The oscillator frequency was found to depend upon the size of the oscillator and other factors. Generally, the frequency f, in Hertz, may be represented by: $f=54.4\ p^{1/2}$, where p is the liquid pressure, in psi, applied to the oscillator over the range of 1–160 psi.

By adding a divider in this fluidic's outlet region, it becomes what can be referred to as two-outlet oscillator of the type that might be used in a windshield washer system. See FIG. 4 and U.S. Pat. No. 4,157,161 to Bauer.

The oscillators described in U.S. Pat. No. 4,151,955 (Stouffer) are quite different from the prior oscillators described above in that they do not depend upon boundary layer attachment fluid flow phenomena. Instead, the oscillators in U.S. Pat. No. 4,151,955 are characterized by their use of a fluid phenomena known as a "Karman vortex street" for dispersing fluid. This oscillator consists of an inlet from which a fluid stream issues in the direction of a downstream island or obstacle which is just before the chamber's outlet opening. See FIG. 5(*a*). As the fluid stream impinges upon the obstacle, a vortex street is established behind the obstacle.

Upon issuing from the outlet, the stream is cyclically swept back and forth by the vortex street. Depending upon a number of factors, including the area of the outlet and the position of the obstacle relative to the outlet, the issued stream can be either a swept jet or a swept fluid sheet, the sheet being disposed generally perpendicular to the plane of the device and being swept in the plane of the device. See FIG. 5(*b*). Similarly, like other fluidics, this fluidic can be configured such that its three-dimensional form has angular symmetry about its centerline. See FIG. 5(*c*) which shows this type of fluidic being used in a shower head. See also U.S. Pat. No. 5,035,361 (Stouffer), which is a continuation-in-part of U.S. Pat. No. 4,151,955, for more illustrations of the various oscillator geometries that may be used with this type of fluidic oscillator.

In the case of the swept jet, the sweeping action causes breakup of the jet into uniformly sized and distributed droplets. In the case of the swept sheet, smaller droplets are formed due to the mutual interaction between two portions of a jet within the region of the device downstream of the obstacle.

The fluidic oscillators described in U.S. Pat. No. 4,231,519 (Stouffer), which was reissued as U.S. Pat. No. RE 33,158, are also quite different from the prior art in that they employ yet another fluid flow phenomena to yield an oscillating fluid output. The oscillators of U.S. Pat. No. 4,231,519 are characterized by their utilization of the phenomena of vortex generation, within an expansion chamber prior to the fluidic's throat, as a means for dispersing fluid. FIG. 6(*a*) shows the general configuration of such a fluidic oscillator. It comprises a jet inlet that empties into an expansion chamber which has an outlet throat at its downstream end. It also has an interconnection passage that allows fluid to flow from one side to the other of the areas surrounding the jet's inlet into its expansion chamber. FIGS. 6(*b*) and 6(*c*) show other similar fluidics that have alternate forms for the geometry of their expansion chambers. Additionally, the interconnection passages lie wholly in the plane of the fluidic, rather than above it as shown in FIG. 6(*a*). Note that the interconnection passage shown in FIG. 6(*c*) is of variable volume. This proves to be useful in controlling the frequency of the oscillating flow from this fluidic.

The general nature of the flow in such fluidics is illustrated in FIG. 6(*d*). Vortices are seen to be formed near the throat. As these grow in size they cause the centerline of the fluid flowing through the expansion chamber to be deflected to one side or the other such that the fan angle, θ, of the jet issuing from the throat ranges from approximately +45 degrees to −45 degrees. The result of these flow oscillations is a complicated spray pattern which at a given instant takes a form similar to that shown in FIG. 6(*e*).

The uniformity of the sprays from fluidic oscillators such as that shown in FIG. 3(*a*) have been further improved upon, according to U.S. Pat. No. 4,508,267 (Stouffer), by further utilizing this phenomena of vortex generation within the fluidic itself, see FIG. 7(*a*). This was reportedly necessary because it was found that prior oscillators tended to have higher spray concentrations at each end of the fans over which the sprays were spread. This phenomena was due to flow in the fluidic's interaction region tending to dwell on the respective sidewalls until the pressure gradient at the power nozzle caused the flow to switch from one sidewall to another.

The fluidic oscillator of FIG. 7(*a*) is characterized by having sidewalls which are laterally remote from the power nozzle exit and protuberances at the ends of these sidewalls. Thus, the interaction region of these oscillators is not the streamlined, diverging/converging cross sections of prior oscillators, but a more box-like shape having protuberances on the downstream end of the laterally remote sidewalls.

The key transitory, flow patterns from and within this fluidic are shown in FIG. 7(*b*). We no longer have boundary layer, wall attachment flow phenomena, but instead have vortexes alternately being formed on either side and just downstream of the power nozzle exit. As these vortices are swept downstream they deflect the jet's direction of flow such that the jet exits the fluidic's throat with its direction oscillating from being plus a certain fan angle, ϕ, from the jet's longitudinal centerline to being minus this same fan angle from the centerline.

The fluidic oscillators disclosed in U.S. Pat. Nos. 5,213,269 (Srinath) and 5,971,301 (Stouffer) are referred to as "box oscillators" having interconnects which serve to help control the oscillating dynamics of the flow that exits from the fluidic's throat. For example, the effect of these interconnects, assuming that they are appropriately dimensioned relative to the other geometry of the fluidic, is generally seen to be about a doubling of the fan angle of the fluid exiting from the fluidic's throat. FIG. 8(*a*) from U.S.

Pat. No. 5,213,269 shows an embodiment in which the interconnect takes the form of passage that connects points on opposite side of the fluid's throat. FIG. 8(*b*) from U.S. Pat. No. 5,971,301 shows an embodiment in which the interconnect takes the form of a slot in the bottom wall of the fluidic's interaction region.

U.S. Pat. No. 6,253,782 (Raghu) discloses a fluidic oscillator of the type that provides a shaped interaction region having two a pair of entering power nozzles and a single throat through which the resulting fluid flow exits the fluidic oscillator. See FIGS. 9(*a*)–(*b*). The jets from the power nozzles are situated so that they interact to form various vortices which continually change their positions and strengths so as to produce a sweeping action of the fluid jet that exits the throat of the fluidic. In a preferred embodiment, the interaction region has a mushroom or dome-shaped outer wall in which are situated the power nozzles.

U.S. Pat. No. 6,186,409 (Srinath) discloses a fluidic oscillator which has two power jets entering a fluid interaction region from the opposite sides of its longitudinal centerline. See FIG. 10. These jets are fed from the same fluid source, and are unique because they employ a filter between the jet source and the upstream power nozzles to remove any possible contaminants in the fluid.

Despite much prior art relating to fluidic oscillators, there still exists a need for further technological improvements in this area. For example, new fluidic oscillators are needed that can provide controllable sprays of droplets that prove to be more beneficial in assorted commercial applications, such as surface cleaning tasks. Additionally, greater tactile pleasure is always desired from the sprays that emanate from shower heads.

OBJECTS AND ADVANTAGES

There has been summarized above, rather broadly, the prior art that is related to the present invention in order that the context of the present invention may be better understood and appreciated. In this regard, it is instructive to also consider the objects and advantages of the present invention.

It is an object of the present invention to provide new, improved fluidic oscillators and fluid flow methods that are capable of generating oscillating, fluid jets having very distinctive and controllable flow patterns.

It is another object of the present invention to provide improved fluidic oscillators and fluid flow methods that yield fluid jets having unique properties that prove to be beneficial in a number of commercial applications.

It is yet another object of the present invention to provide improved fluidic oscillators and fluid flow methods that yield fluid jets and sprays of droplets having properties that make them more efficient for surface cleaning applications.

It is still another object of the present invention to provide improved fluidic oscillators and fluid flow methods that yield fluid jets and sprays of droplets having properties that make them more pleasurable to use in various human showering activities.

These and other objects and advantages of the present invention will become readily apparent as the invention is better understood by reference to the accompanying summary, drawings and the detailed description that follows.

SUMMARY OF THE INVENTION

Recognizing the need for the development of improved fluidic oscillators that are capable of providing a broader variety of spray patterns having controllable liquid droplet shapes, the present invention is generally directed to satisfying the needs set forth above and overcoming the disadvantages identified with prior art devices and methods.

In accordance with the present invention, the foregoing need can be satisfied by providing a fluidic oscillator that in a preferred embodiment is comprised of the following elements: (1) a switching chamber having an inlet port that allows a pressurized liquid to enter and flow through the oscillator, (2) an exhaust passage having a sidewall that forms one boundary wall of the switching chamber, (3) a container passage having a sidewall that forms the second boundary wall of the switching chamber, (4) an expandable, gas-filled container connected to the distal end of the container passage, and (5) an expansion chamber connected to the distal end of the exhaust passage, with the expansion chamber having an exhaust orifice that allows liquid to flow from the oscillator. In operation, such an oscillator yields a liquid jet that issues from the inlet port into the switching chamber and alternately tries to switch its flow direction between the container and exhaust passages. This switching action serves to generate a controllable series of pressure waves in the exhaust passage and expansion chamber which act to control the pattern of the liquid that flows from the orifice.

In another preferred embodiment, the present invention takes the form of a method for providing a free fluid jet from fluid under pressure, with the jet having distinctive, controllable and useful flow patterns. The steps in this method include: (1) forming a contained fluid jet, (2) deflecting the contained jet between an exhaust passage and a container passage, (3) providing the exhaust passage at its distal end with an expansion chamber, with this chamber having an orifice that allows the fluid to flow from the chamber, (4) providing the container passage at its distal end with a container, wherein the container and its contents work together to provide this distal end with specified compliance capabilities, and (5) generating controlled pressure waves in the exhaust passage and expansion chamber as a result of these jet deflections, with the pressure waves acting to control the pattern of the fluid jet that flows from the orifice.

Thus, there has been summarized above, rather broadly, the present invention in order that the detailed description that follows may be better understood and appreciated. There are, of course, additional features of the invention that will be described hereinafter and which will form the subject matter of any eventual claims to this invention.

BRIEF DESCRIPTION OF THE DRAWINGS

FIG. 8(*b*) from U.S. Pat. No. 5,971,301 shows a prior art "box oscillator" of the type having an interconnection slot in its bottom wall as a means of helping to control the oscillating dynamics of the flow that exits from the fluidic's throat.

DESCRIPTION OF THE PREFERRED EMBODIMENT

Figure 1:
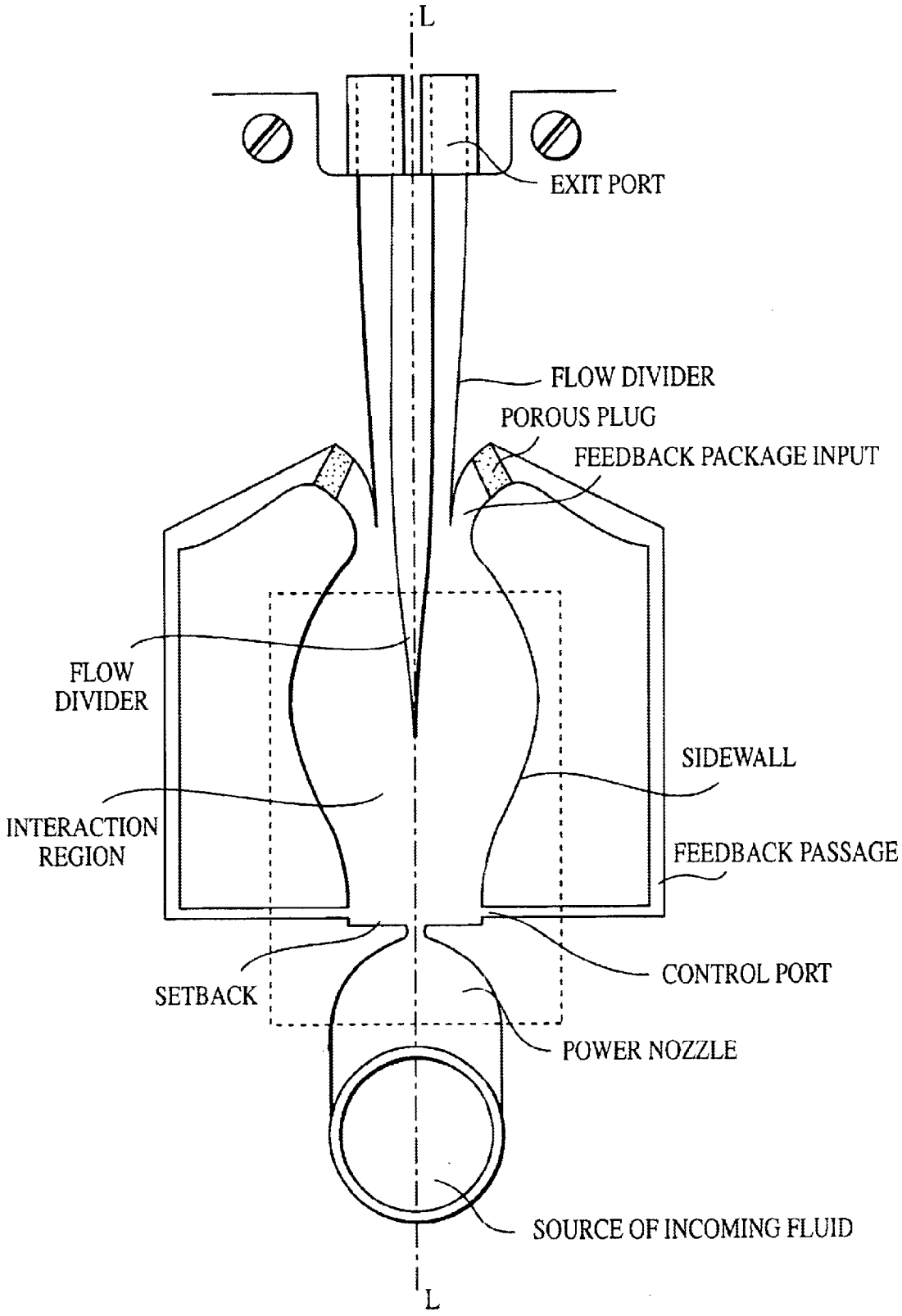
FIG. 1 PRIOR ART
FIG. 1 from U.S. Pat. No. 3,185,166 shows a prior art fluidic oscillator that is characterized by its use of boundary layer attachment and downstream feedback passages to cause the jet issuing from the fluidic to periodically oscillate.
Figure 2:
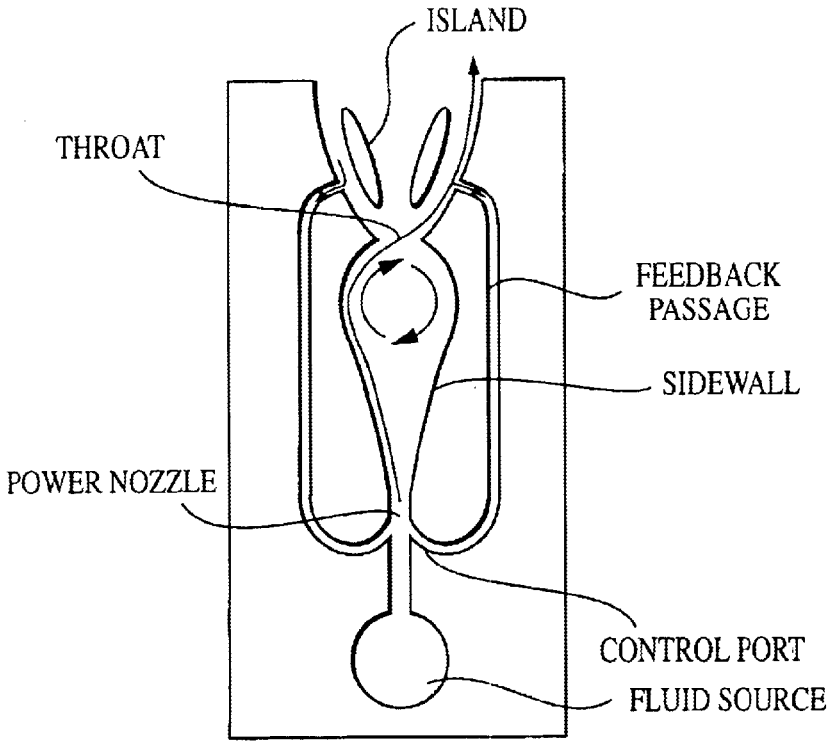
FIG. 2 PRIOR ART
FIG. 2 from U.S. Pat. No. 3,563,462 shows a prior art fluidic oscillator that is characterized by its use of a flow-reversing, interaction region and downstream feedback passages to yield a relatively low frequency oscillator of the type having numerous practical applications, such as in shower heads, lawn sprinklers, etc.
Figure 3A:
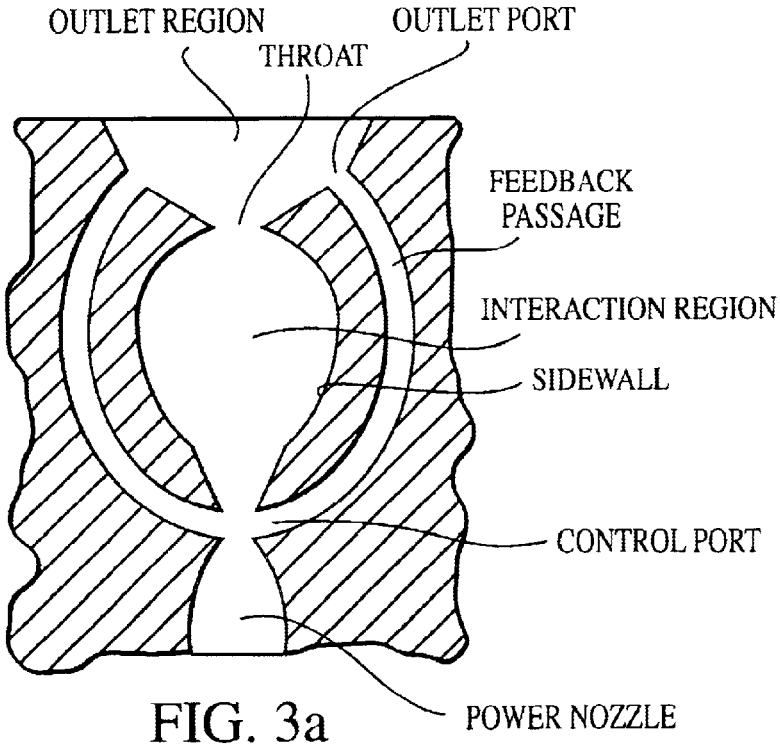
FIG. 3a PRIOR ART
FIGS. 3(*a*)–(*b*) from U.S. Pat. No. 4,052,002 shows a prior art fluidic oscillator with a flow-reversing, interaction region and feedback passages in which its dimensions are such that no ambient fluid or primary jet fluid is ingested back into the fluidic's interaction region, which results in a spray having droplets of a more uniform size.
Figure 3B:
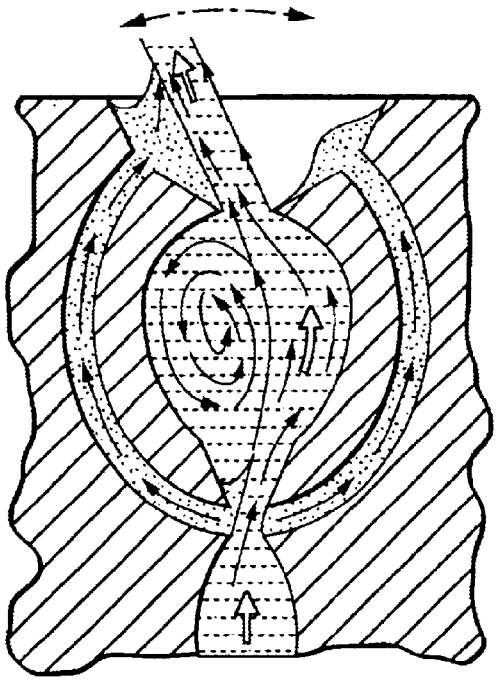
FIG. 3b PRIOR ART
Figure 4:
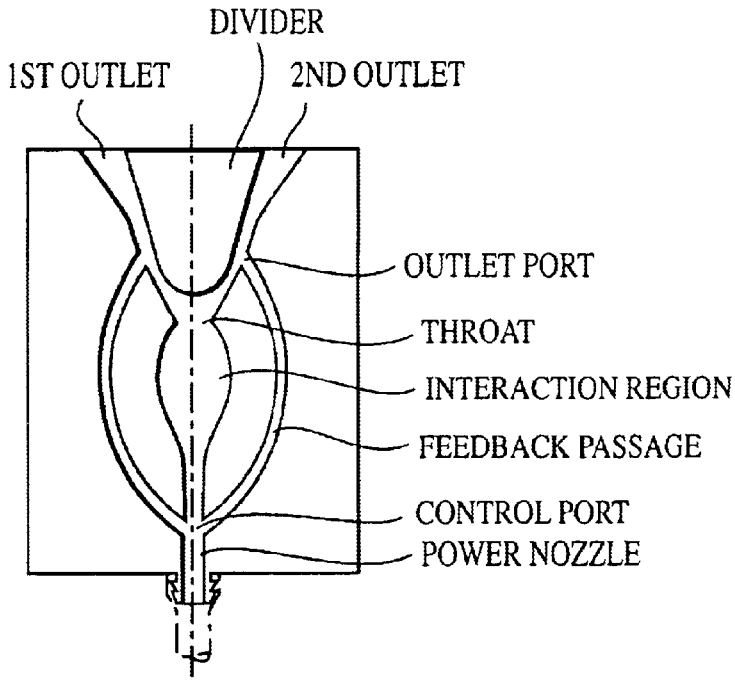
FIG. 4 PRIOR ART
FIG. 4 from U.S. Pat. No. 4,157,161 shows the oscillator of FIG. 3 having a divider in the fluidic's outlet region; such an oscillator is often used in windshield washer systems.
Figure 5A:
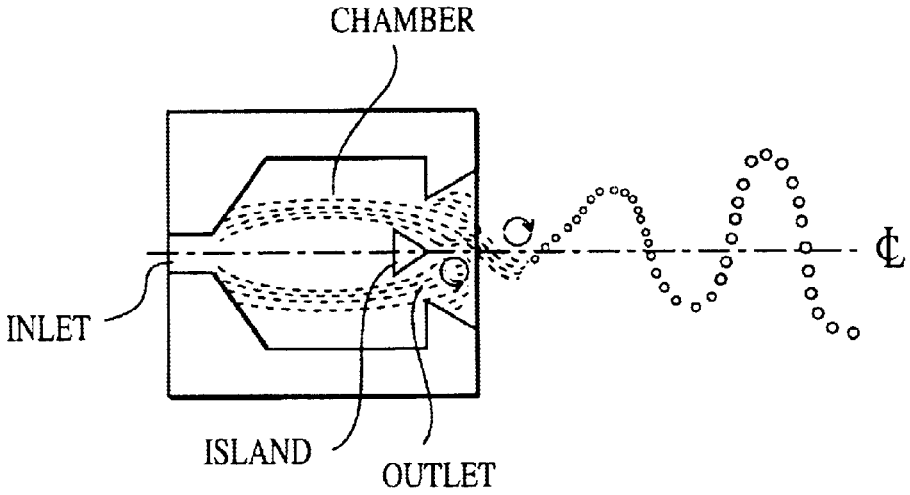
FIG. 5a PRIOR ART
FIGS. 5(*a*)–(*c*) from U.S. Pat. No. 4,151,955 shows a prior art fluidic oscillator of the type characterized by its generation of a "Karnan vortex street" for dispersing the flow from the oscillator.
Figure 5B:
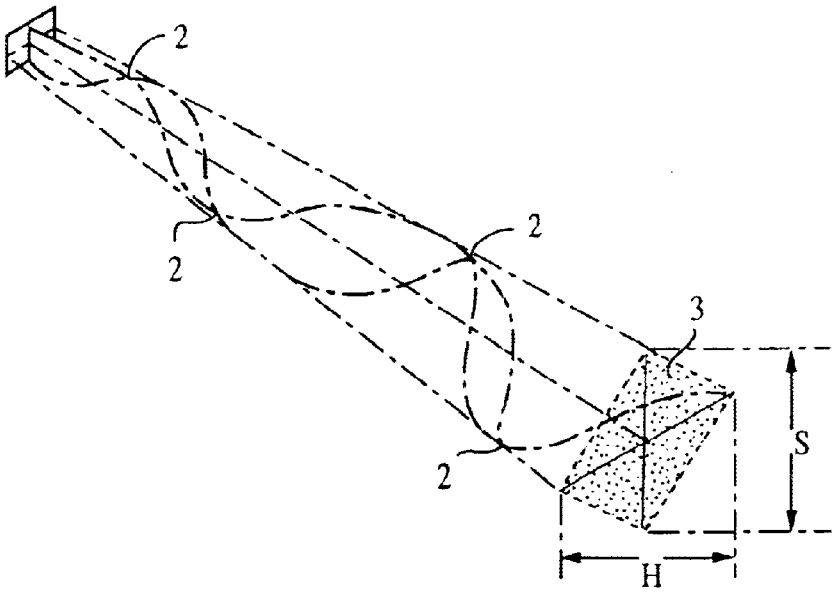
FIG. 5b PRIOR ART
Figure 5C:
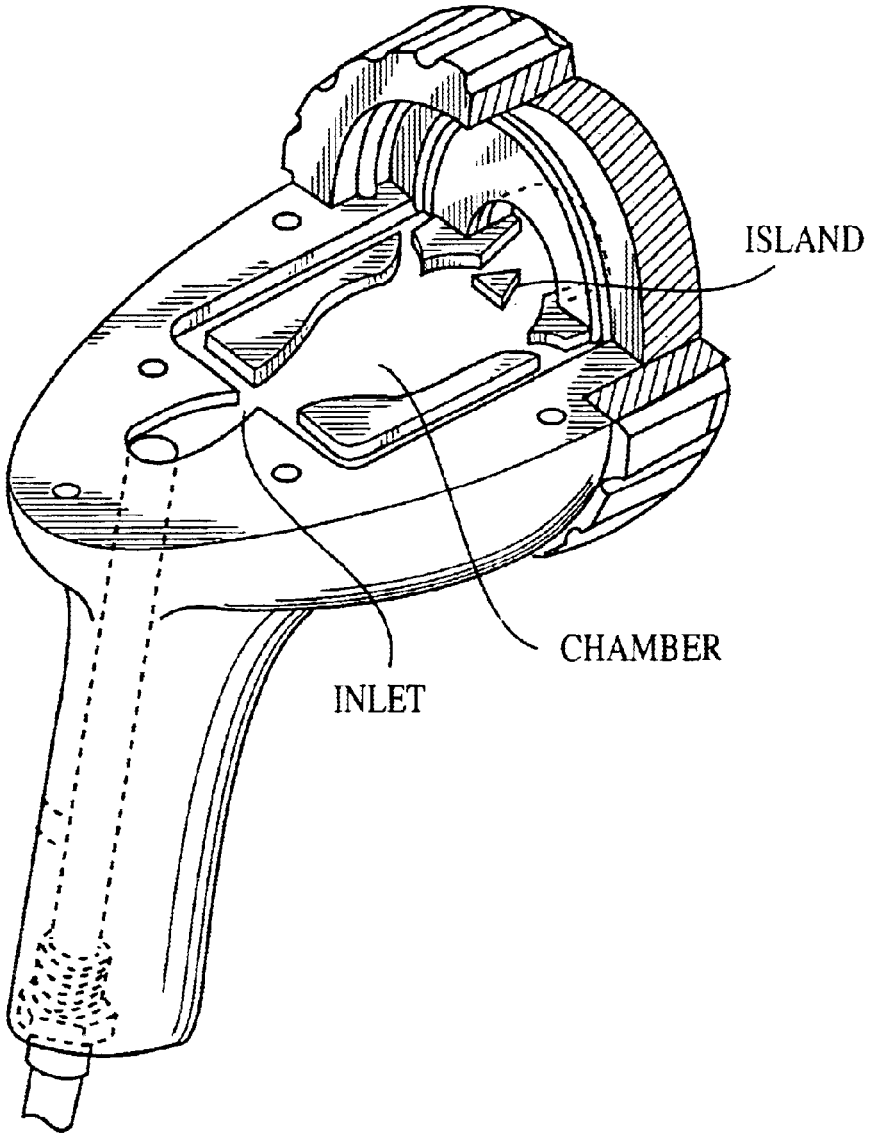
FIG. 5c PRIOR ART
Figure 6D:
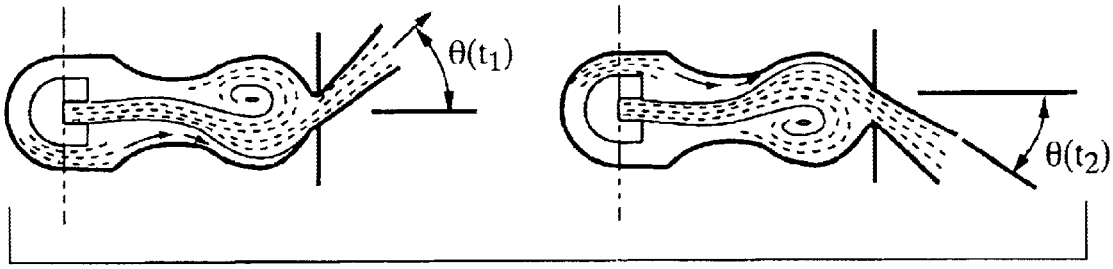
FIG. 6d PRIOR ART
FIGS. 6(*a*)–(*e*) from U.S. Pat. No. 4,231,519 shows a prior art fluidic oscillator of the type characterized by its laterally remote sidewalls and interconnection passage adjoining the fluidic's power nozzle; such an arrangement results in the generation of interacting vortices within the downstream expansion chamber and the oscillating flow of the fluid exiting the fluidic's throat.
Figure 6E:
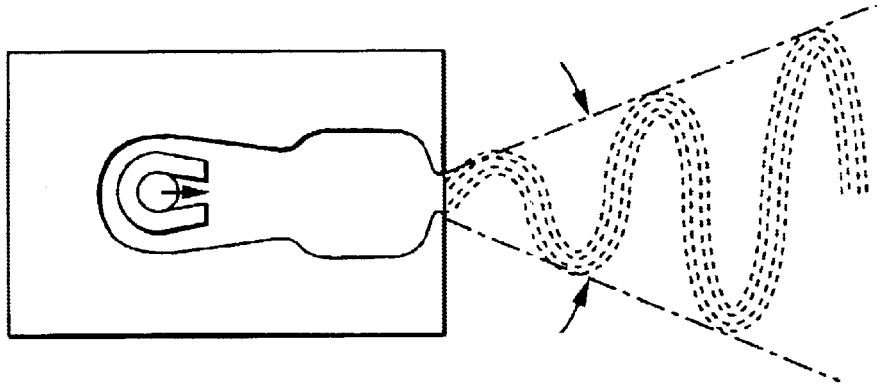
Figure 7A:
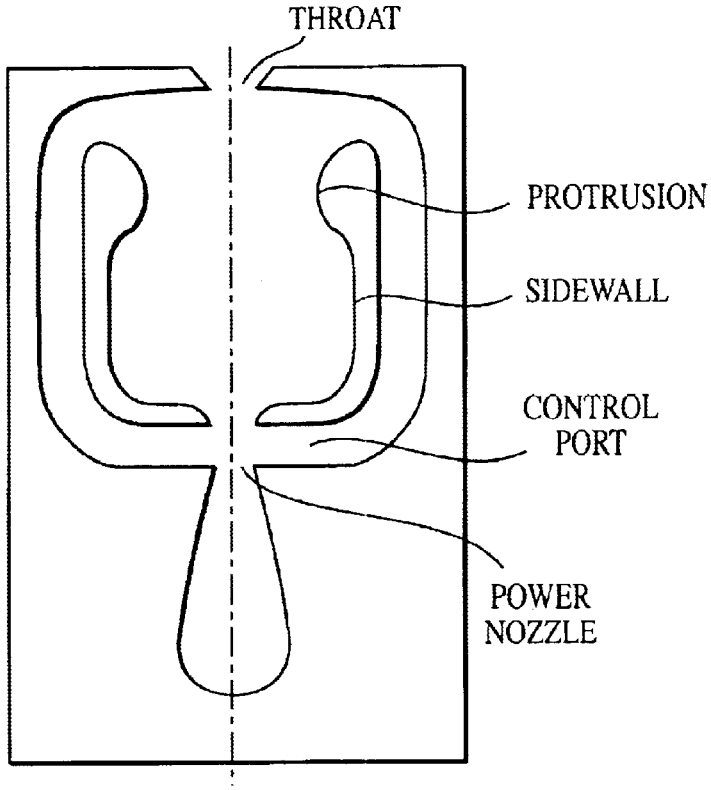
FIG. 7a PRIOR ART
FIGS. 7(*a*)–(*b*) from U.S. Pat. No. 4,508,167 shows a prior art fluidic oscillator of the type characterized by its laterally remote sidewalls and protuberances at the ends of these sidewalls; such an arrangement results in the generation of interacting vortices within the downstream expansion chamber and the oscillating flow of the fluid exiting the fluidic's throat.
Figure 7B:
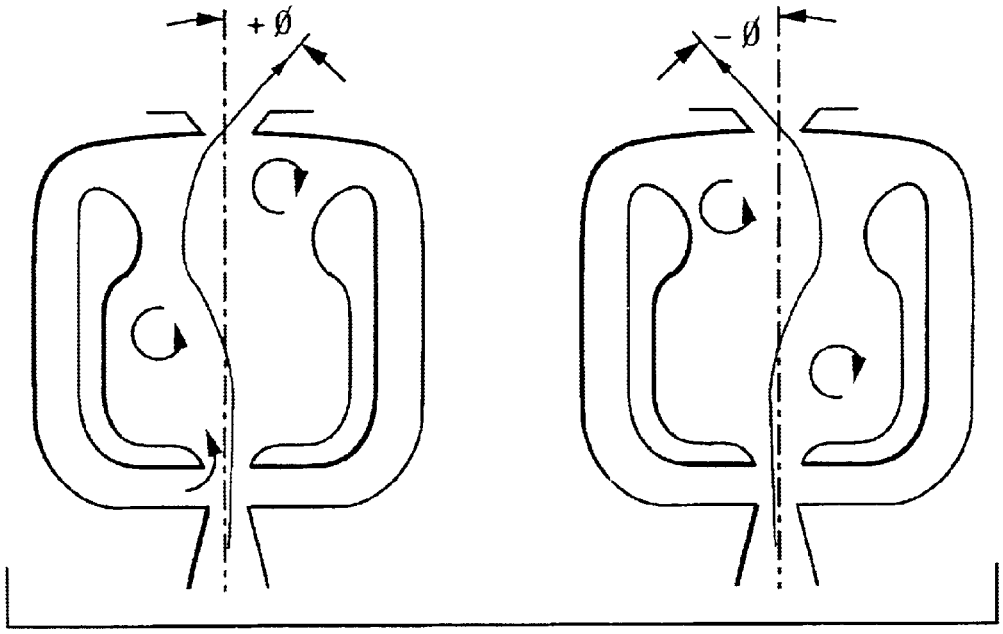
FIG. 7b PRIOR ART
Figure 8A:
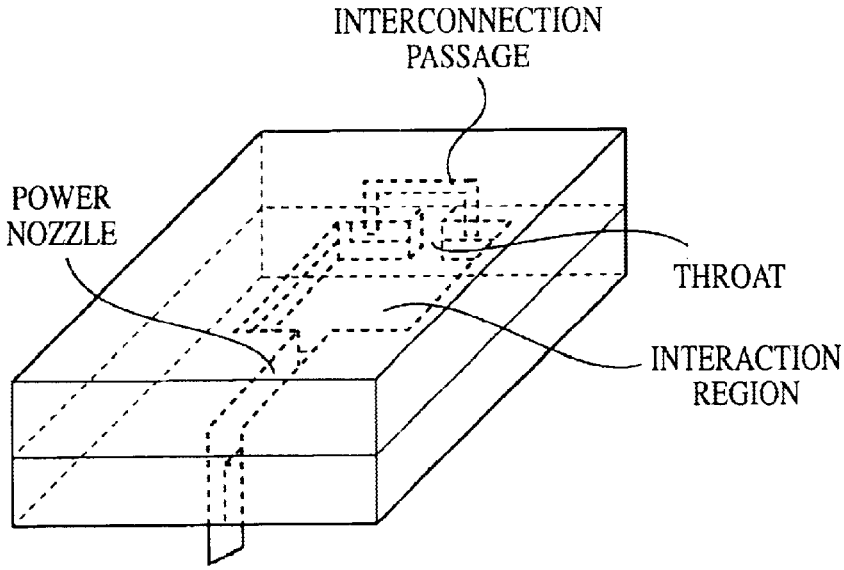
FIG. 8a PRIOR ART
FIG. 8(*a*) from U.S. Pat. No. 5,213,269 shows a prior art "box oscillator" of the type having an interconnect passage that connects points on opposite side of the fluid's throat as a means of helping to control the oscillating dynamics of the flow that exits from the fluidic's throat.
Figure 8B:
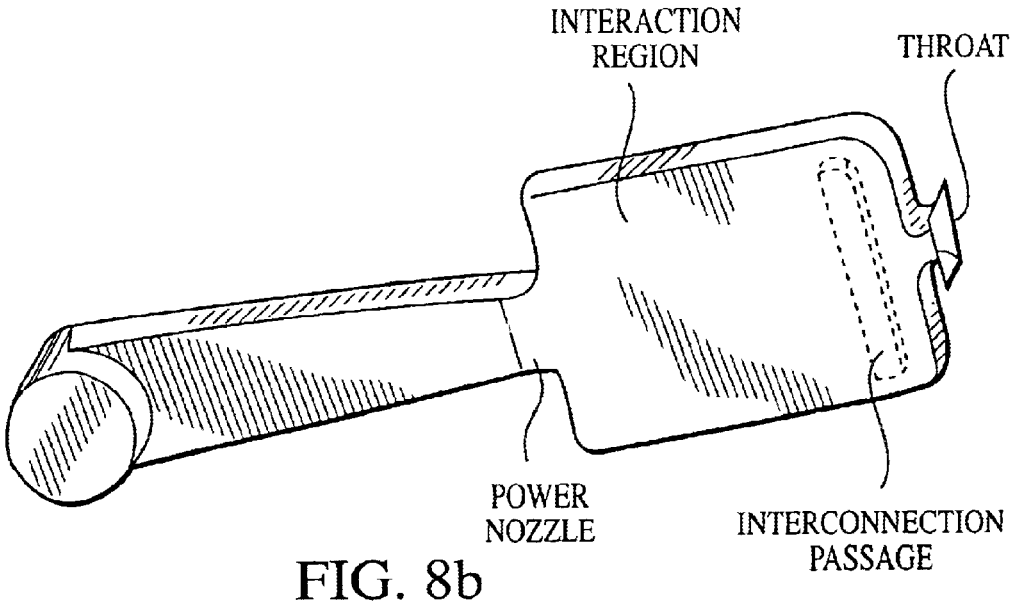
FIG. 8b PRIOR ART
Figure 9A:
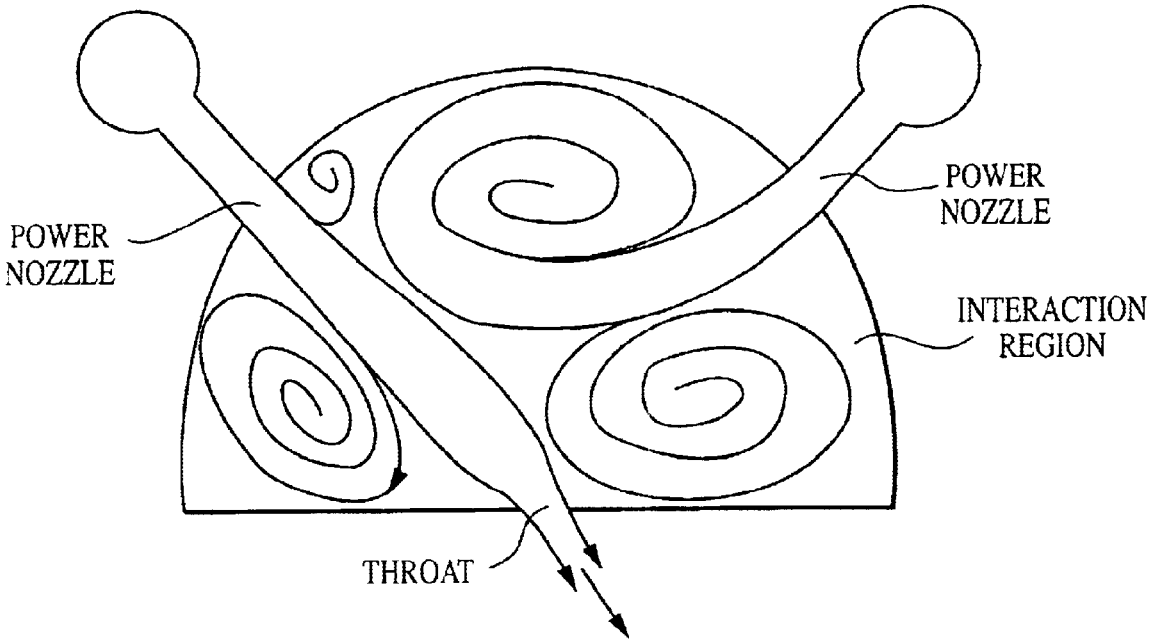
FIG. 9a PRIOR ART
FIGS. 9(*a*)–(*b*) from U.S. Pat. No. 6,253,782 shows a prior art "box oscillator" of the type a mushroom-shaped interaction region into which enters the jets from a pair of power nozzles; these jets interact to form interacting vortices which yield an oscillating flow from the fluidic's throat.
Figure 9B:
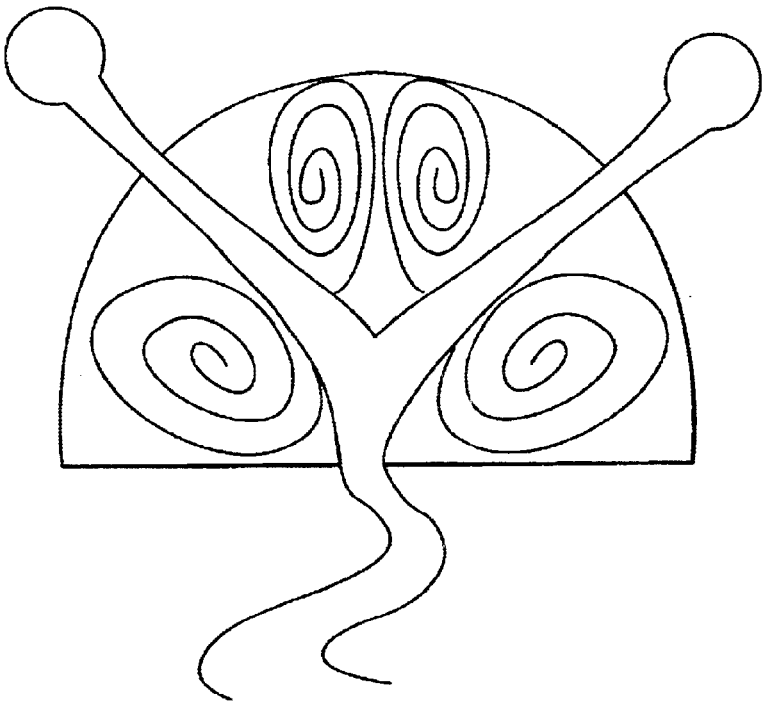
FIG. 9b PRIOR ART
Figure 10:
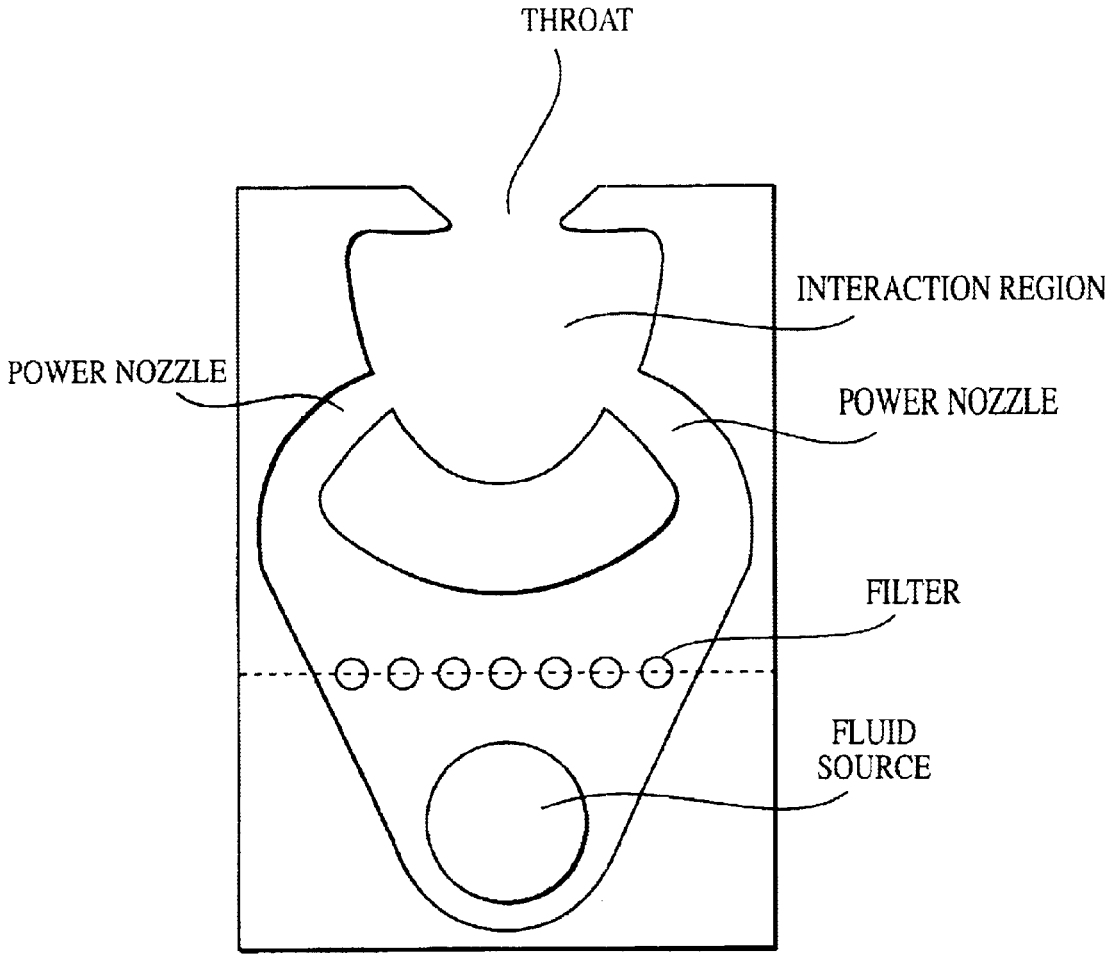
FIG. 10 PRIOR ART
FIG. 10 from U.S. Pat. No. 6,186,409 shows a prior art fluidic oscillator having an upstream filter that removes any possible contaminants in the flow to the power nozzle.

Before explaining at least one embodiment of the present invention in detail, it is to be understood that the invention is not limited in its application to the details of construction and to the arrangements of the components set forth in the following description or illustrated in the drawings. The invention is capable of other embodiments and of being practiced and carried out in various ways.

Also, it is to be understood that the phraseology and terminology employed herein are for the purpose of description and should not be regarded as limiting. For example, the discussion herein below generally relates to liquid spray techniques; however, it should be apparent that the inventive concepts described herein are applicable also to the dispersal of other fluids, including gases, fluidized solid particles, etc.

The present invention involves methods for creating fluidic oscillators of the type that are suitable for generating oscillating, fluid jets having very distinctive and controllable flow patterns that are found to yield physical phenomena that prove be beneficial in a number of commercial applications. For example, in terms of free, liquid-gas jets, controlling the shape of such a jet's free surface makes it possible to produce new types of shower and sink sprays that have improved efficiency for surface cleaning applications. Alternatively, controlling the shape of such a jet's free surface can make it possible to produce unique tactile sensations on one being impacted by such sprays.

Figure 11:
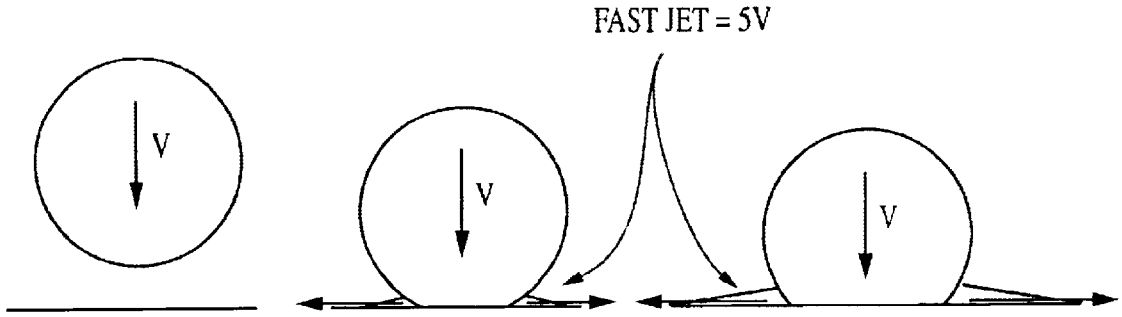
FIG. 11 shows the process of a spherical liquid drop impacting on a horizontal surface.

To understand how such phenomena are possible, consider FIG. 11 which shows the process of a spherical liquid drop impacting on a horizontal surface. For this process, it is known that at the drop's impact point on the surface a radially outward directed flow of fluid is created that has a mean radial speed that is approximately five times that of the magnitude of the drop's impact velocity on the surface. This relatively high speed component of the flow proves to be quite effective for surface cleaning applications.

Figure 12:
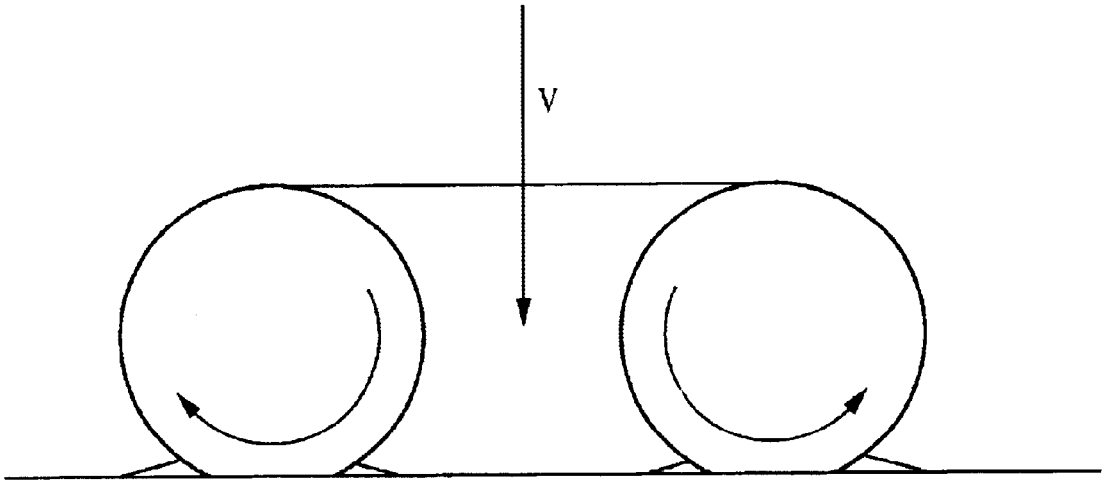
FIG. 12 shows a spinning toroid or vortex ring impacting on a horizontal surface.

In terms of fluid jets within a single fluid environment, a spinning toroid or vortex ring, such as that commonly observed in a smoke ring, is also known to generate appreciable radial velocities at the perimeter of the points where such toroids impact against a solid surface. See FIG. 12. These higher velocity radial components of the flow are known to be quite effective when the purpose of the impacting toroid is to transfer heat or cold away from the impacted surface.

Figure 13:
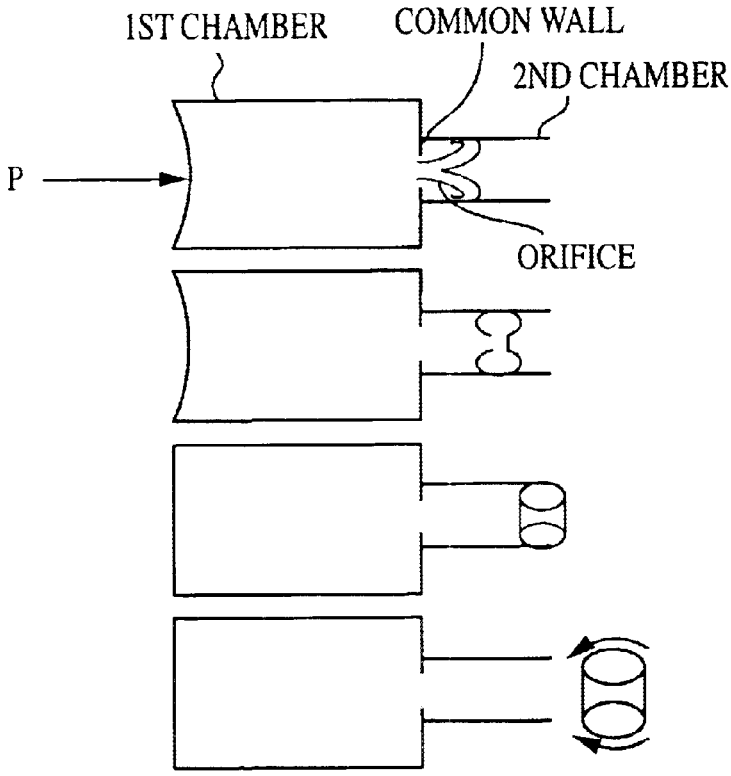
FIG. 13 shows a method of producing a spinning toroid or vortex ring.

A known method of producing these spinning toroids is to produce a sharp pressure wave that acts upon a fluid contained within a two chambered cylinder, with the chambers being of differing outside diameters, having open ends and being separated by a common wall which has an orifice connecting the chambers. See FIG. 13. When the pressure pulse is applied to the fluid, it creates a jet that flows through the orifice and expands outward until its boundaries come into contact with second chamber's outer wall which retards this flow as the central core of the jet continues outward so as to create a spinning toroid which exits from the open end of the second chamber. After exiting the second chamber, the spinning toroid or vortex ring expands to adjust to the stagnant conditions in the surrounding fluid.

Using this knowledge, I undertook a number of experiments to try to develop a new type of fluidic oscillator that would be capable of automatically generating such spinning toroids. As a result of these experiments, I have been able to create such flows by using a unique, new type of fluidic oscillator that alternately exhausts into either the atmosphere or into a closed container having a prescribed volume and expansion characteristics.

Figure 14:
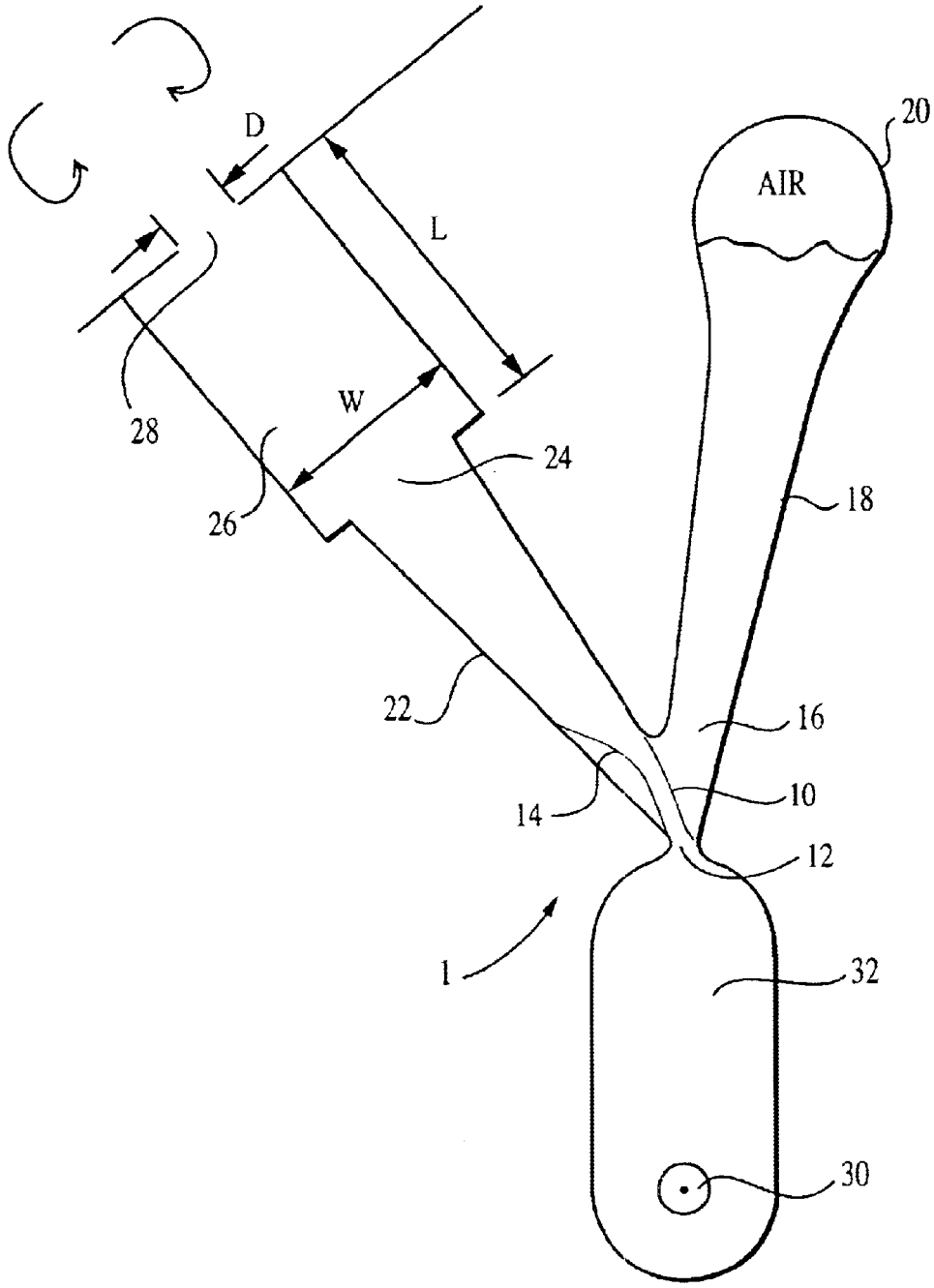
FIG. 14 shows a preferred embodiment of a fluidic oscillator of the present invention.

Referring now to the drawings wherein are shown preferred embodiments and wherein like reference numerals designate like elements throughout, there is shown in FIG. 14 a fluidic oscillator 1 of the present invention. It consists of a switching chamber 10 having an inlet port 12 and two outlet ports, an exhaust port 14 and a container port 16. To the container port 16 is connected a container passage 18 which connects at its distal end to a container 20. This container and its contents work together to provide this distal end with specified compliance or expansion capabilities. To the exhaust port 14 is connected an exhaust passage 22 which contains at its distal end an opening 24 that connects to an expansion chamber 26 having a specified width, W, length, L and an orifice 28 of a specified dimension, D. To the inlet port 12 is connected a source of pressurized fluid 30 via an inlet passage 32.

Figures 15A, 15B, 15C, 15D:
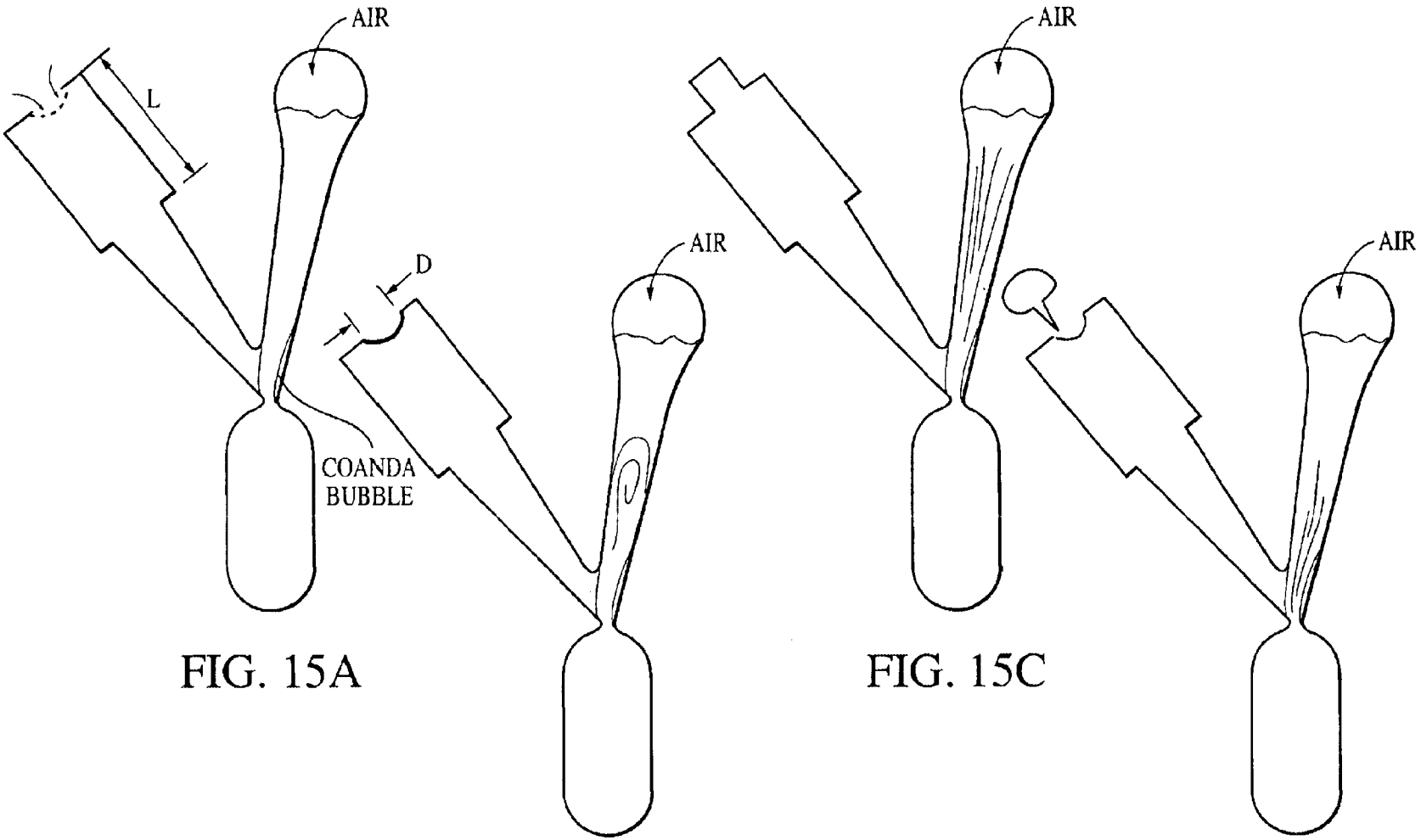
FIGS. 15(*a*)–(*d*) demonstrates the method of operation of the present invention using water as the input fluid and with air in the fluidic's container.
Figure 16A:
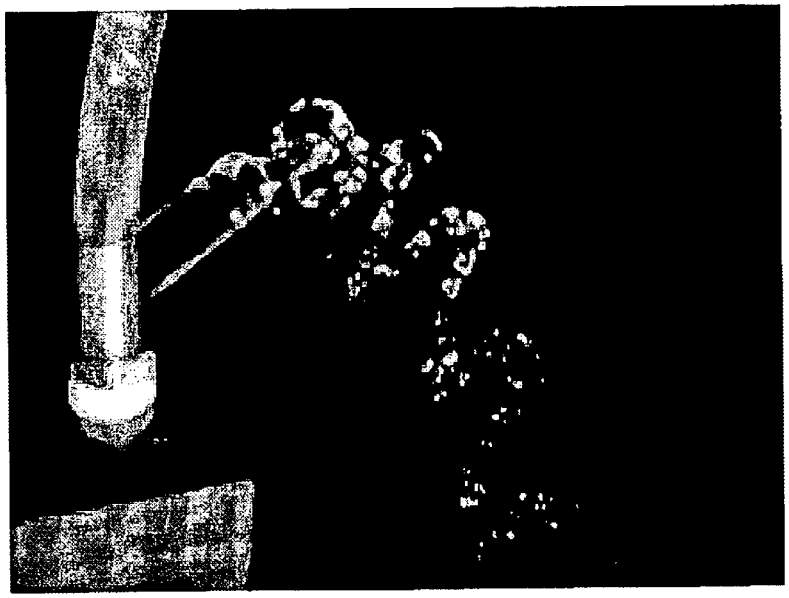
FIGS. 16(*a*)–(*i*) show experimental results where various types of spray shapes have been generated by using expansion chambers having different combinations of the dimensions L and D.
Figure 16A:
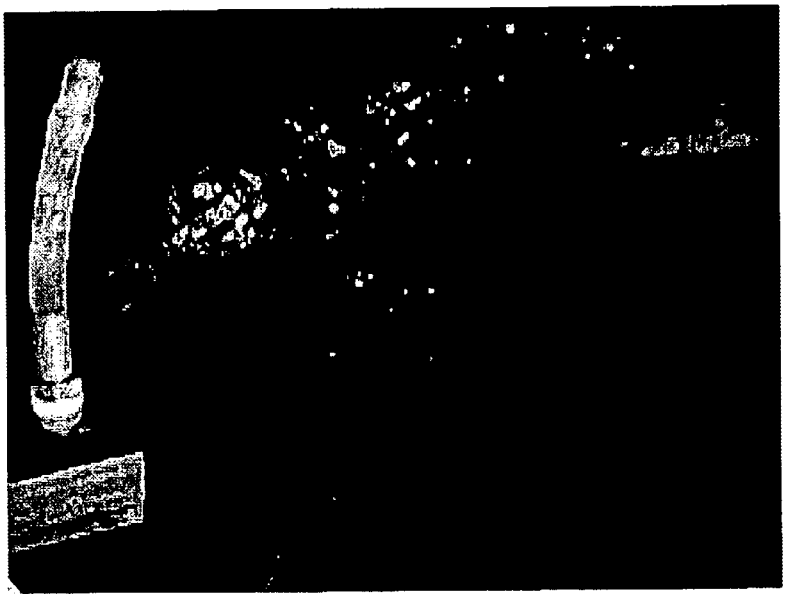
Figure 16B:
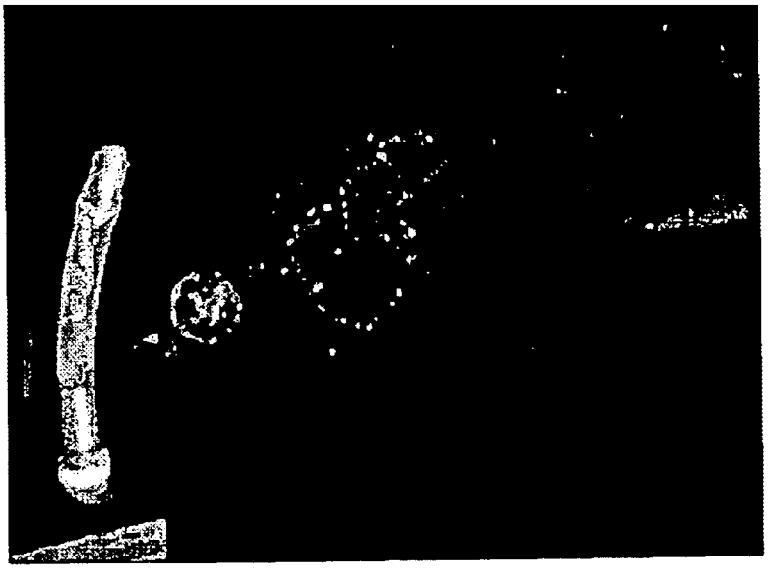
Figure 16B:
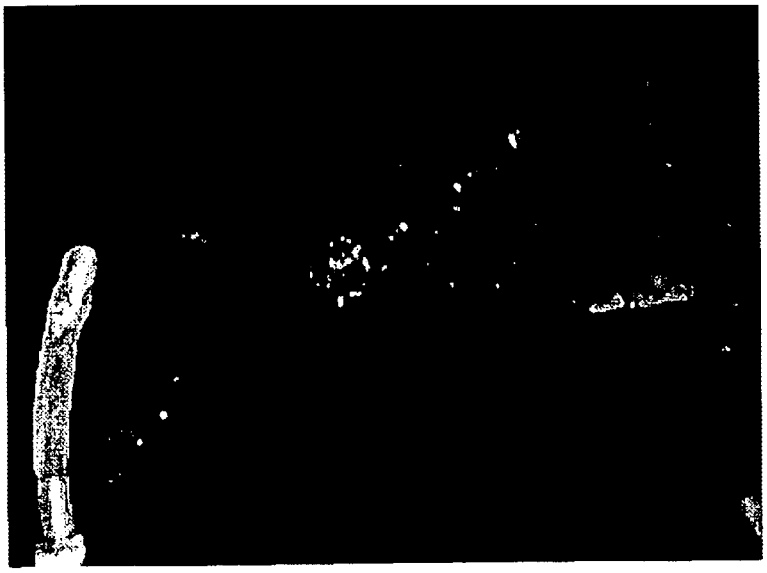
Figure 16C:
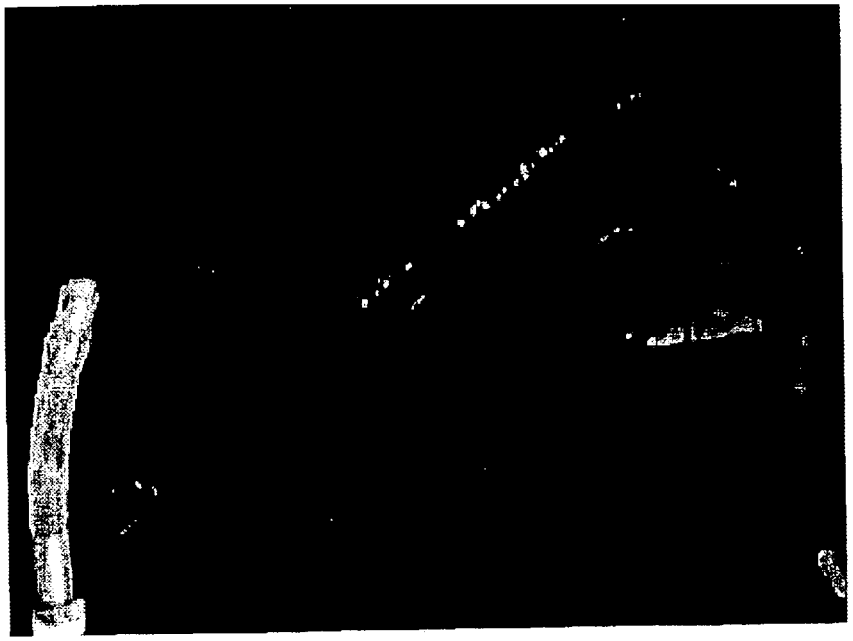
Figure 16C:
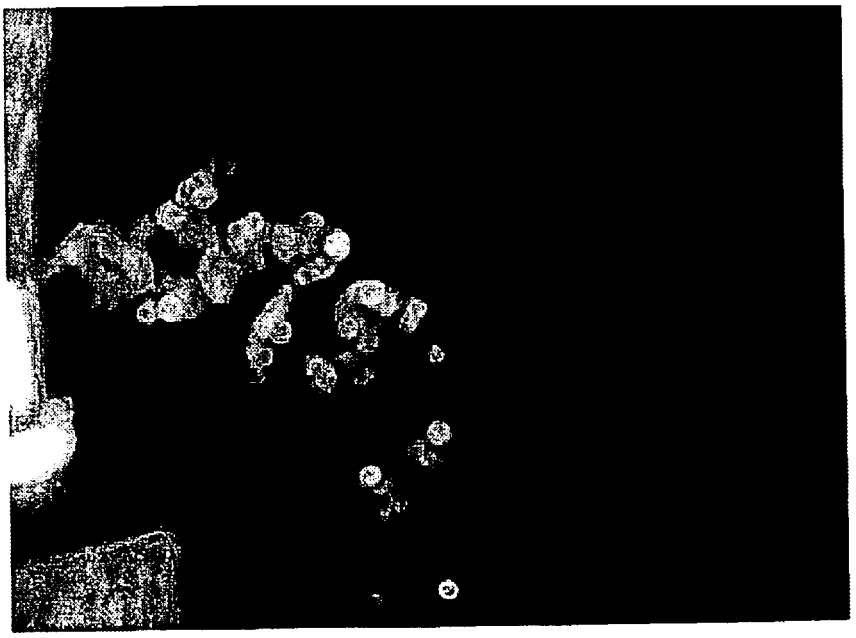
Figure 16D:
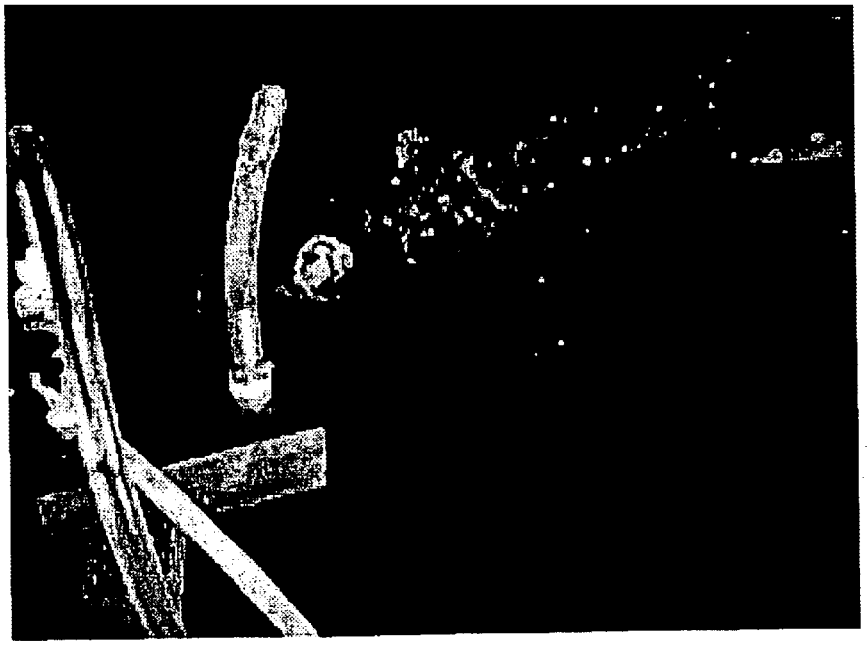
Figure 16D:
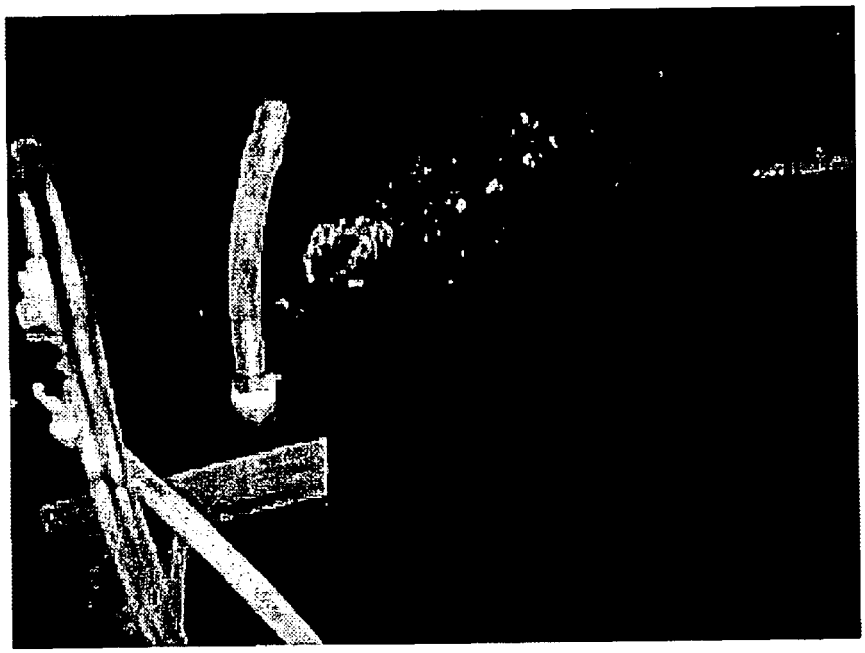
Figure 16E:
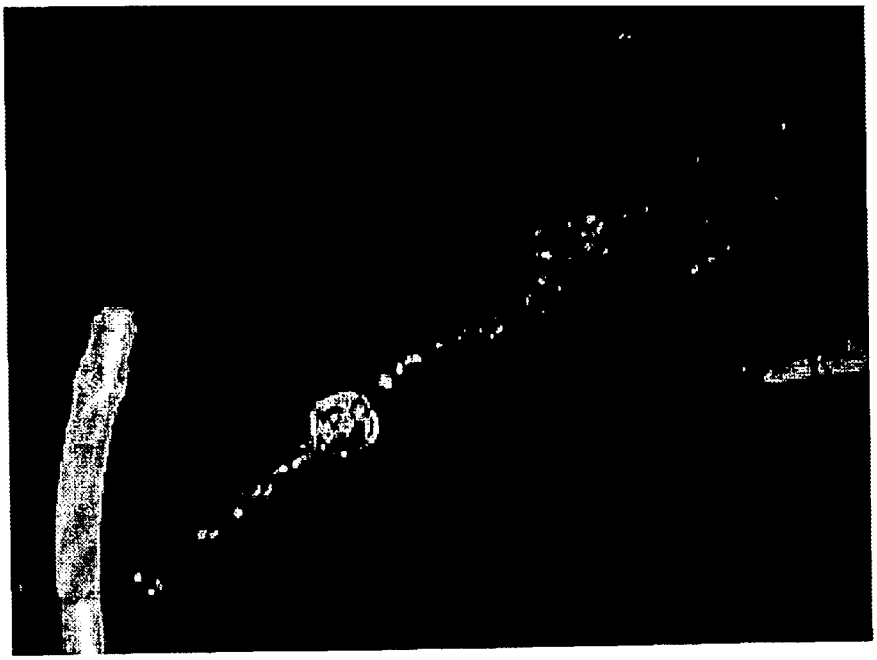
Figure 16E:
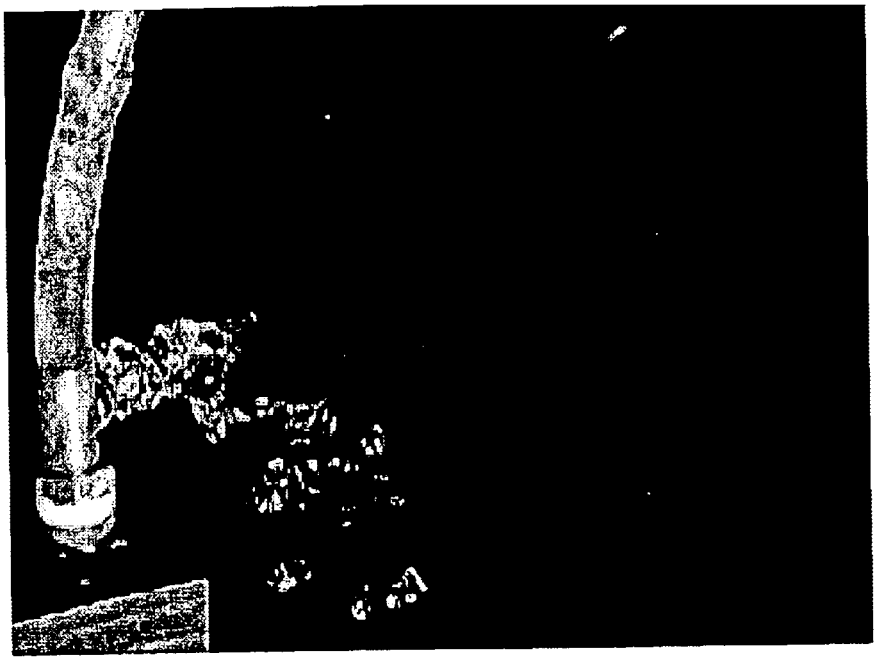
Figure 16F:
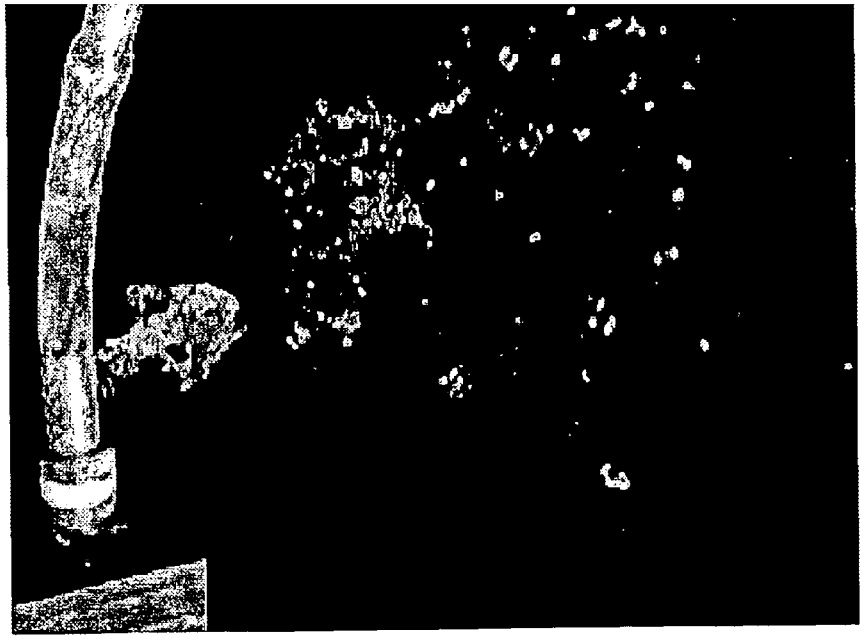
Figure 16F:
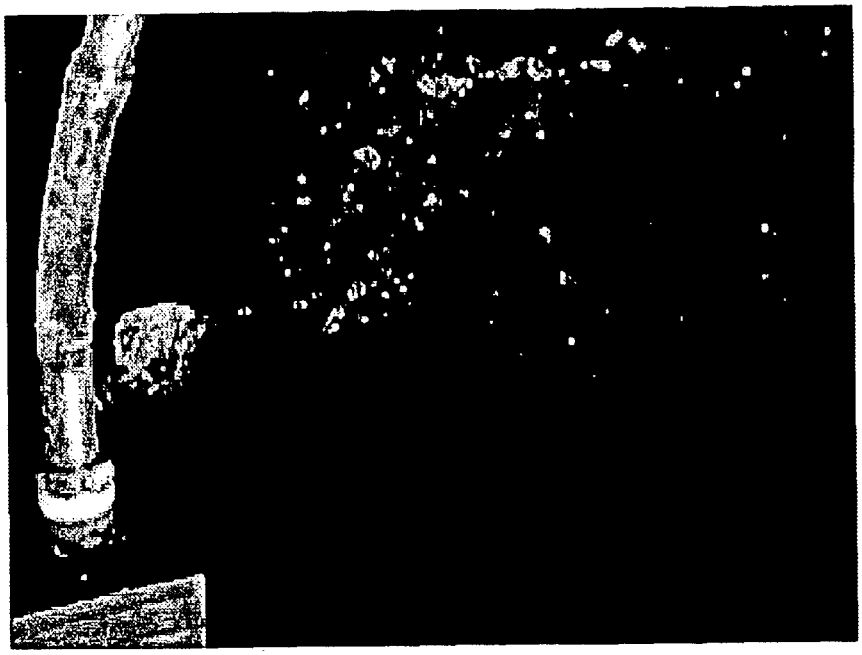
Figure 16G:
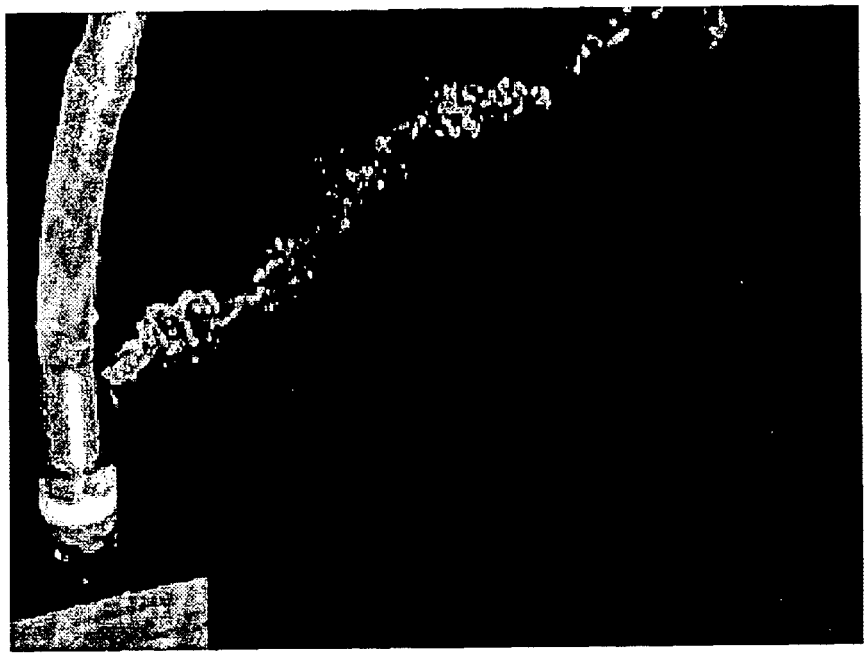
Figure 16G:
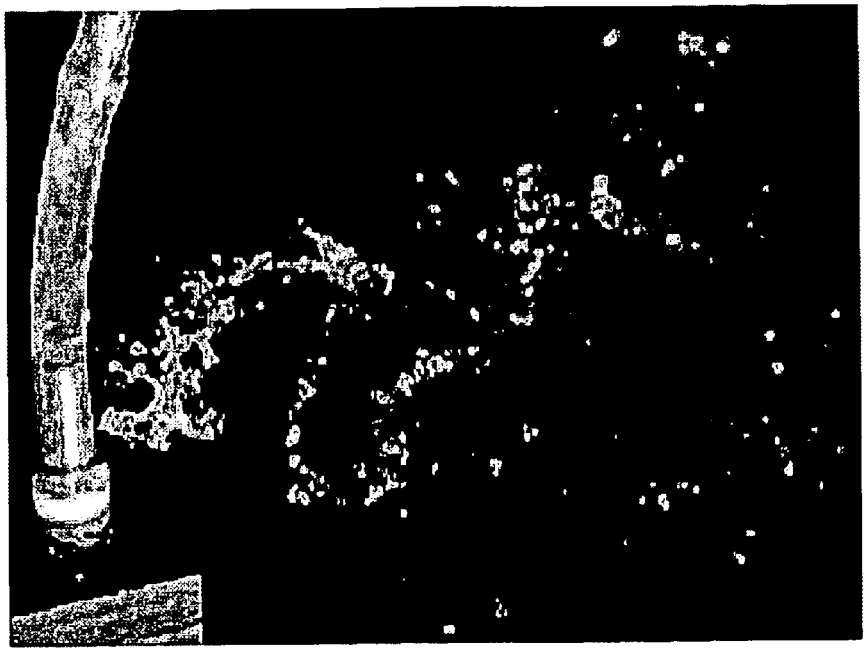
Figure 16H:
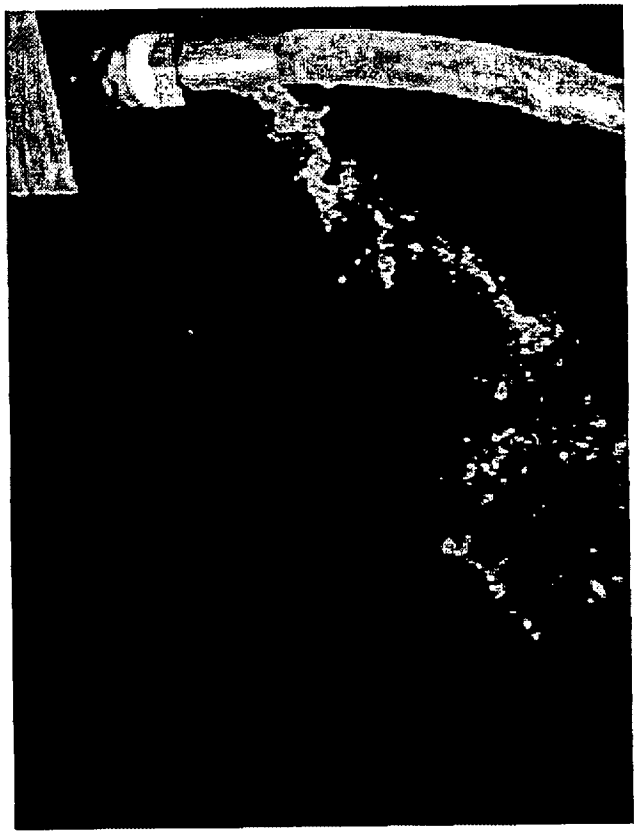
Figure 16H:
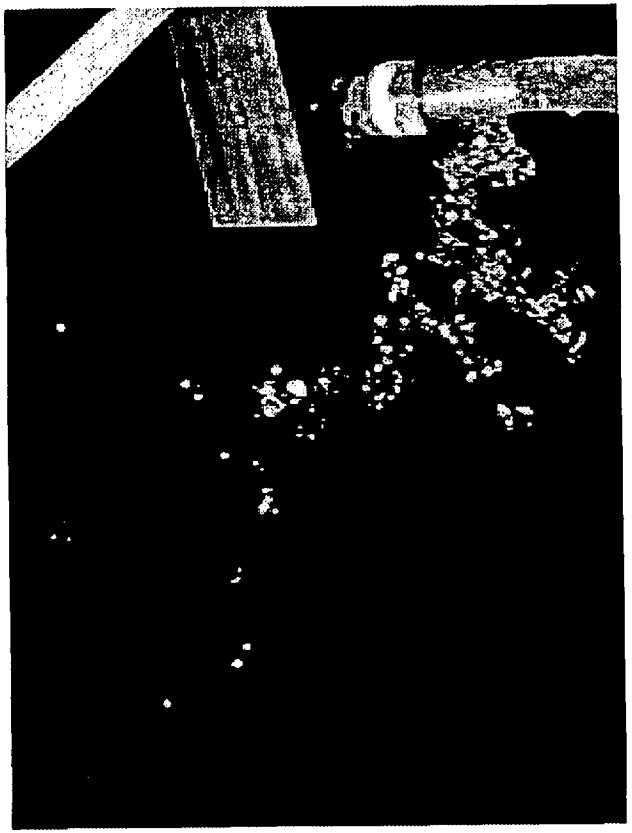
Figure 16I:
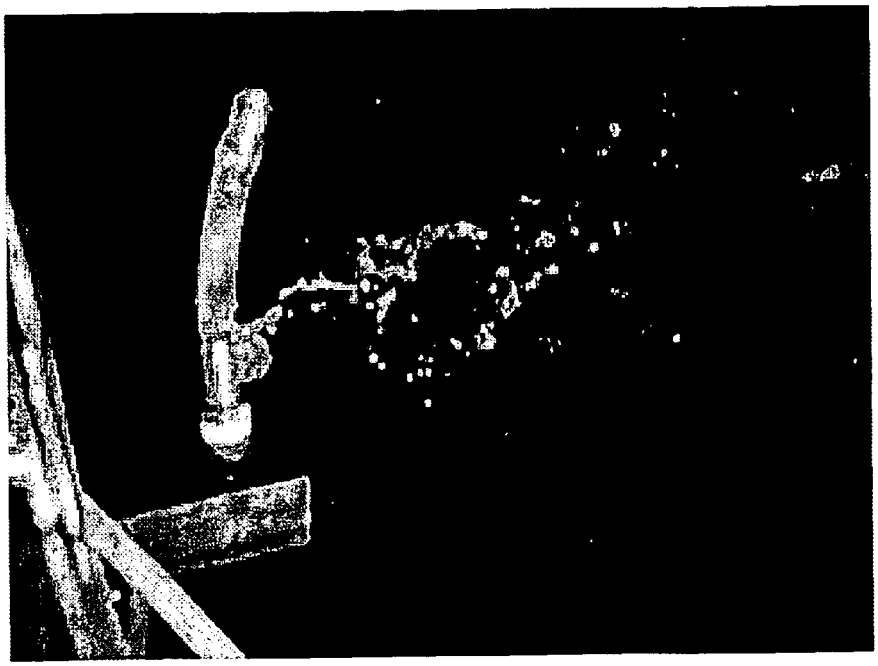
Figure 16I:
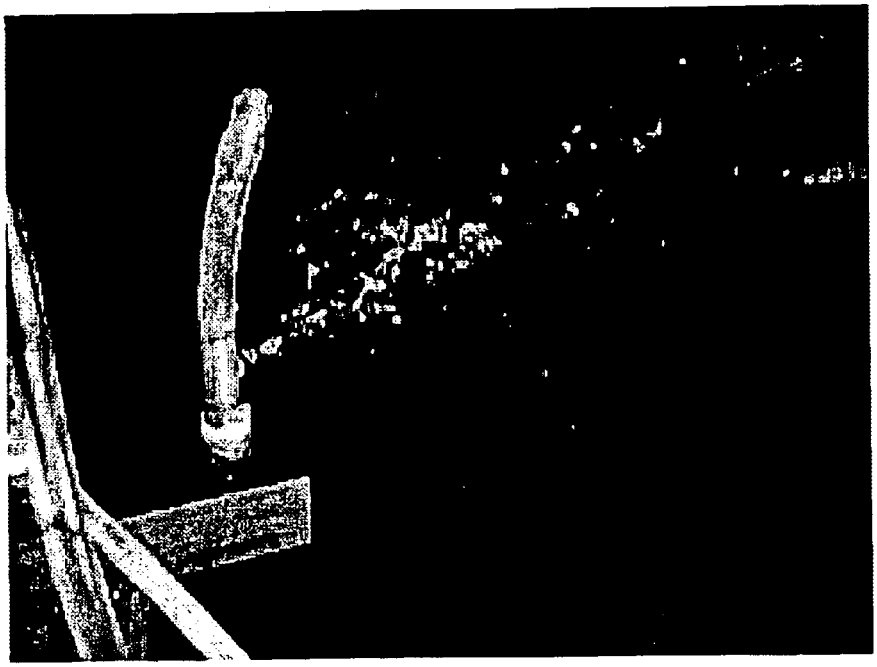
Figure 17A:
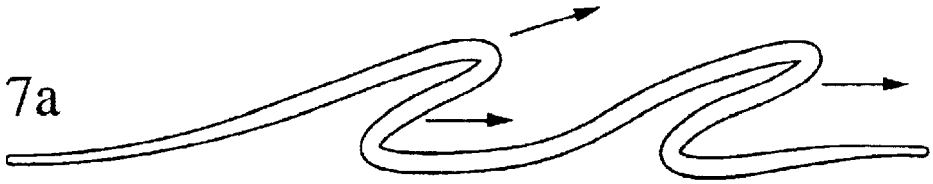
FIGS. 17(*a*)–(*e*) shows, at different downstream locations, the apparent appearance of various portion of a free, liquid-gas jet issuing from a preferred embodiment of the present invention.
Figure 17B:
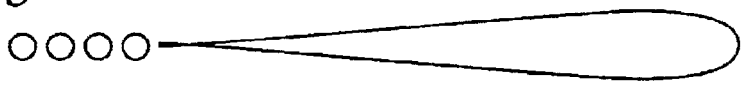
Figure 17C:
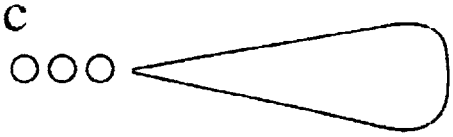
Figure 17D:
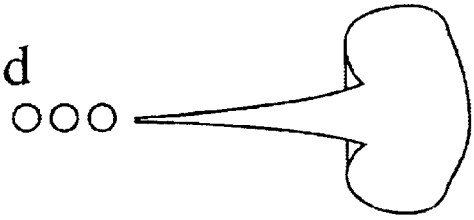
Figure 17E:
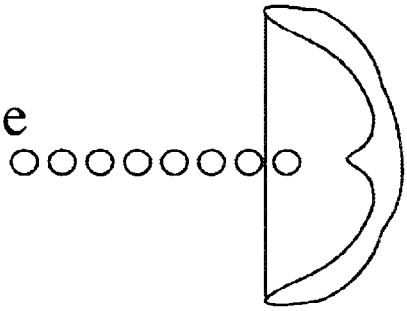

In a preferred manner of operation, water or other suitable liquid from the source flows through the inlet port 12 and because it is at sufficient pressure enters the switching chamber 10 as a jet. Because air can be entrained through the expansion chamber's orifice 28 to satisfy the jet's entrainment requirement on its left side, the jet initially tries to attach to the chamber's right wall where a Coanda bubble is seen to form, thereby producing a lower pressure area on the jet's right side. See FIG. 15(*a*) where water is entering the fluidic 1 and the container 20 contains air. The pressurization of the container continues until, in FIG. 15(*b*) the flow stops in the right leg and the right-hand Coanda bubble is increased in pressure. Then, when the pressure differential across the jet is reversed, so that the left side pressure is lower than the right, the jet switches to the left side of the chamber, see FIG. 15(*c*), with such a speed and intensity as to create a pressure wave in the fluidic's exhaust passage and expansion chamber. This pressure wave causes the output water flow to issue a rapid, top-hat profiled jet, see FIG. 15(*d*), that subsequently expands into various liquid spray shapes depending on the values of the geometric variables of L and D of the fluidic's expansion chamber.

The reflecting pressure spike switches the power jet back to the contained port and the process is repeated resulting in a series of unique free, liquid-into-gas jet shapes being exhausted from the expansion chamber's orifice.

While the above discussion has centered on free, liquid-into gas jets, it should be recognized that liquid-into-liquid and gas-into-gas jets can be created using preferred embodiments of the present invention. Such jets have many commercial applications. For example, gas-into-gas jets are used in various drying applications, while liquid-into-liquid jets are utilized in various types of spas.

It has been found that a preferred embodiment of the present invention can generate free, liquid-gas jets whose free surfaces have a variety of specified shapes. If the expansion chamber's geometry is arranged to produce a laterally oscillating, free jet flow, and the remainder of the fluidic is designed to produce lower frequency pulses, then the jet's spray can be cast about over a wide area. With expansion chamber geometry impedance matched to the rest of the fluidic, individual jet droplets can be produced having a wide variety of shapes.

For example, FIGS. 16(*a*)–(*i*) show the experimental results obtained from high speed photographs of various types of spray shapes that were generated by using expansion chambers 26 having different combinations of the expansion chamber dimensions L and D. It can be seen that as the ratio L/D increases that the free jet goes from being a laterally oscillated, relatively continuous jet to a unique assortment of sprays whose droplets appear to be uniquely distributed over the area of the spray and to have unique, non-spherical shapes (e.g., individual droplets having the approximate shape of an ice cream cone).

Figure 18:
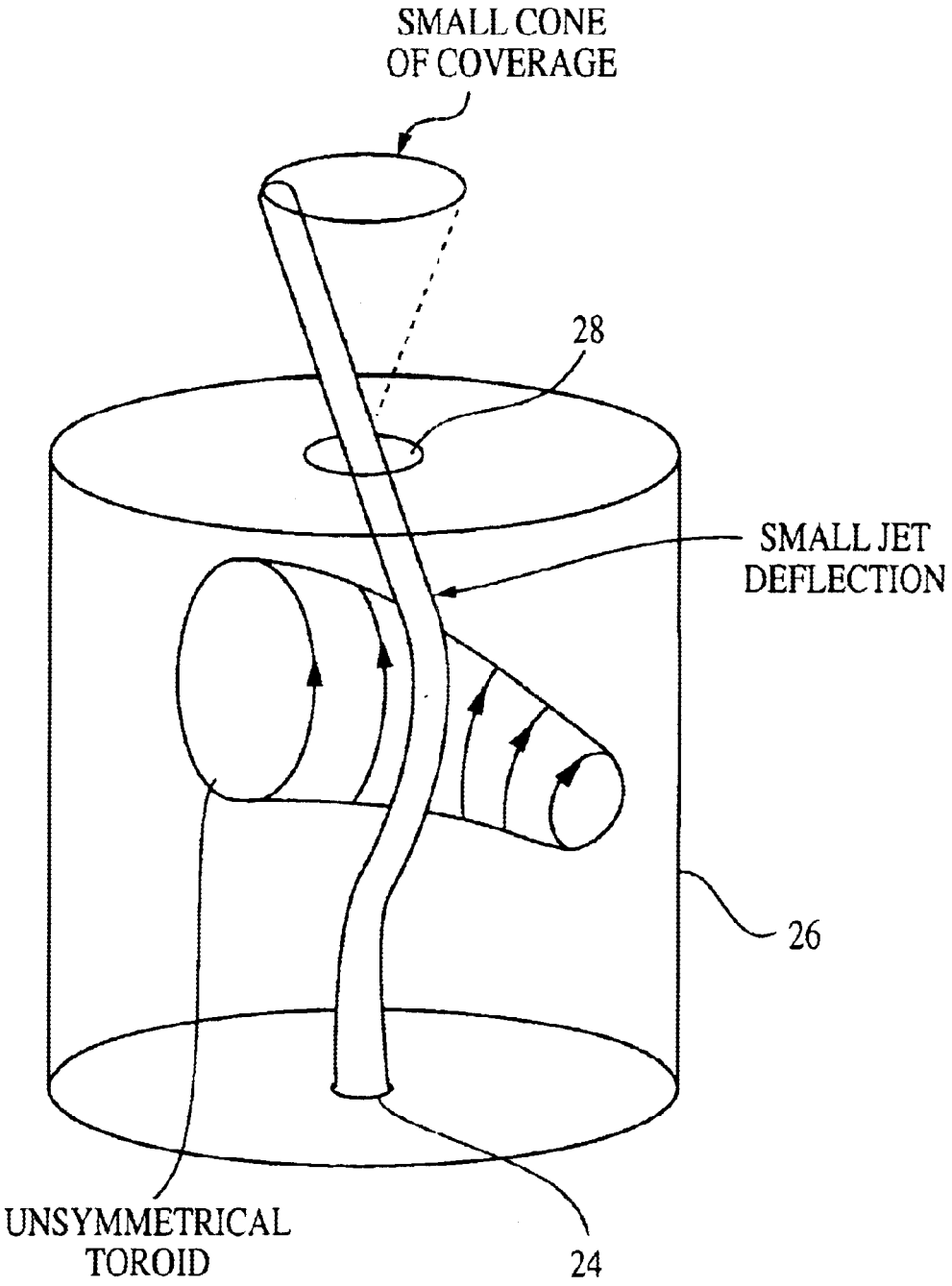
FIG. 18 illustrates the flow phenomena occurring within the expansion chamber in a preferred embodiment of the present invention.

In an attempt to better explain how this liquid jet breakup process is occurring, FIGS. 17(*a*)–(*e*) shows the apparent appearance of various portion of the free, liquid-into-gas jet at different downstream locations. At the location closest to the orifice, 17(*a*), the jet still forms a continuous column of water as it is being spread by the vortex occurring with the expansion chamber, see FIG. 18. At the next downstream location, 17(*b*), the jet is no longer continuous and various portions of the columnar jet have folded upon themselves so as to significantly widen the front portion of the broken up jet that is shown. The smaller width portions of the jet have broken into droplets. Further downstream, this slug of liquid is seen to continue to widen until it takes the form of an ice cream cone, 17(*d*), and then a tear drop, 17(*e*) being followed by a string of water droplets.

Initial studies of these unique free, liquid-gas jets impacting on a surface suggests that they may be more effective at cleaning the surface upon impact than that which could be obtained with a correspondingly pressured round jet which isn't being pressure spiked by the action of the unique fluidic oscillator of the present invention.

Figure 19:
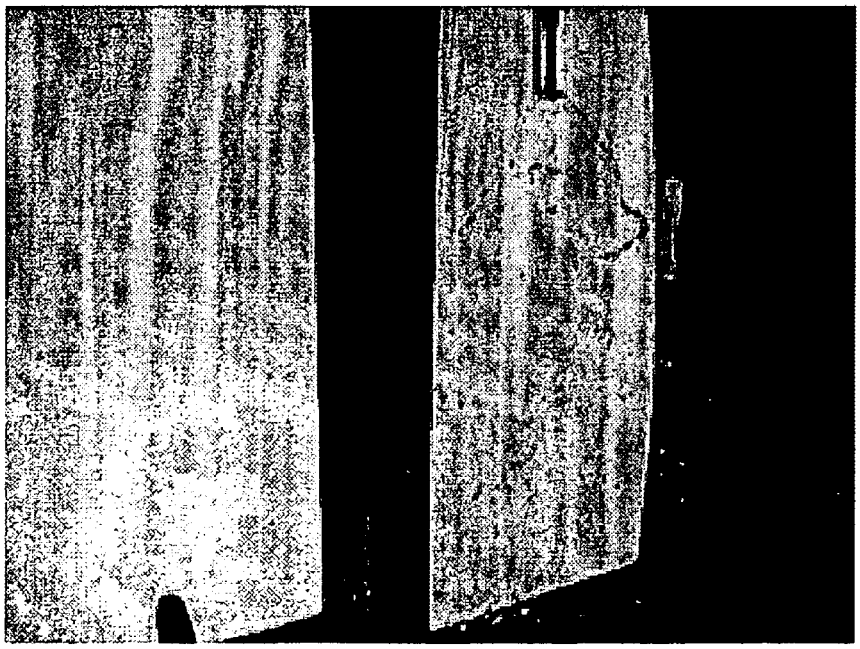
FIG. 19 shows an expansion chamber with an annular orifice being used to generate a spay whose shape takes a form resembling a bell.
Figure 19:
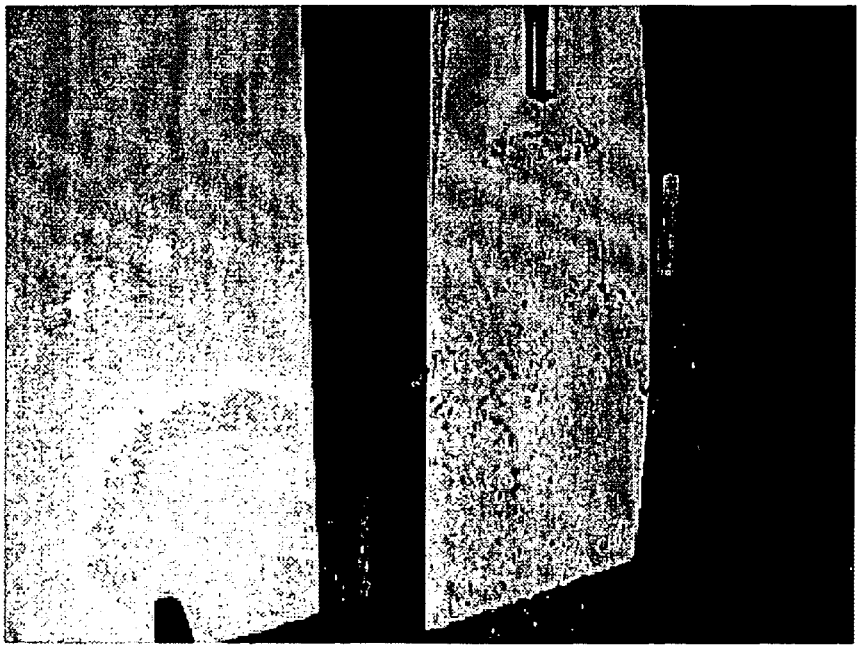

Further experimental results have shown that when the expansion chamber's orifice is annular in shape rather than round, the resulting spray's shape takes a form resembling a bell, see FIG. 19. Similarly, it has been found that when the orifice is a sharp-edged orifice, such as where its edges taper away from its centerline in the downstream direction, the edges of the resulting free jet are more clearly defined and generally larger droplet sizes are noted.

Figure 20:
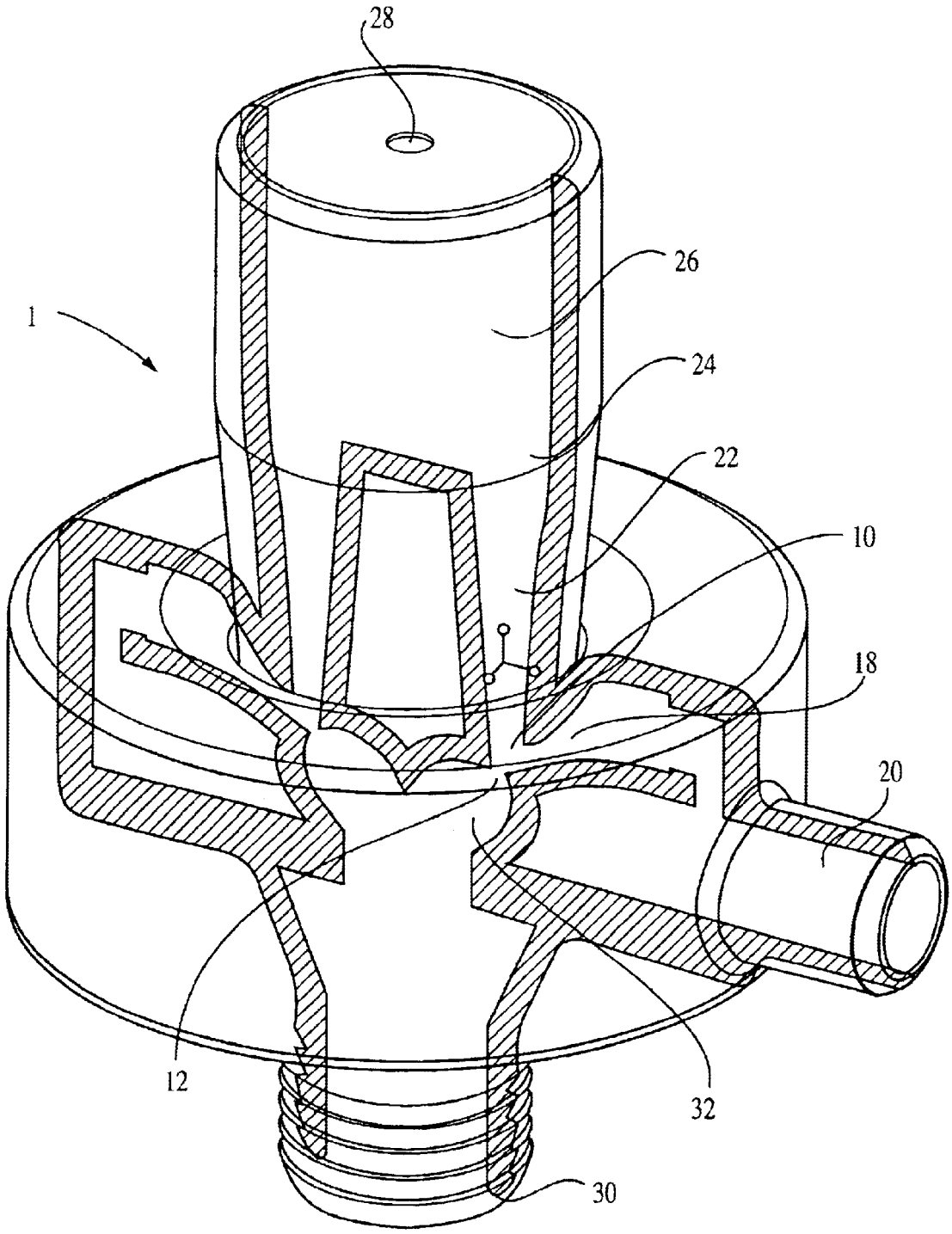
FIG. 20 shows how the present invention can be configured in the form of a three-dimensional body of revolution.

Rather than the planar version of the fluidics of the present invention shown above, it should be noted that the present invention can be configured in the form of a three-dimensional body of revolution or a shower head. See FIG. 20. The primary elements of the present invention can clearly be seen in this embodiment: switching chamber 10, inlet port 12, container passage 18, container 20, exhaust passage 22, expansion chamber 26 having an orifice 28, source of pressurized fluid 30 and an inlet passage 32.

In this shower head application, some typical key dimensions for a preferred embodiment of the present invention that is designed for operation at a flow rate of 2.5 gallons per minute are: width of the inlet port is 0.03 inches, with the diameter to the inner edges of the inlet port being 0.25 inches.

Although the foregoing disclosure relates to preferred embodiments of the invention, it is understood that these details have been given for the purposes of clarification only. Various changes and modifications of the invention will be apparent, to one having ordinary skill in the art, without departing from the spirit and scope of the invention as hereinafter set forth in the claims.

I claim:

1. A fluidic oscillator capable of generating fluid jets having distinctive, controllable and useful flow patterns, said oscillator comprising:

a switching chamber having an inlet port that allows a pressurized fluid to enter and flow through said oscillator, an exhaust passage having a sidewall that forms a first boundary wall of said switching chamber, a container passage having a sidewall that forms a second boundary wall of said switching chamber, a container connected to the distal end of said container passage, wherein said container and its contents working together to provide said distal end with specified compliance capabilities, and an expansion chamber connected to the distal end of said exhaust passage, said expansion chamber having an orifice that allows fluid to flow from said oscillator.

2. A fluidic oscillator as recited in claim 1, wherein said oscillator being operable so as to yield a fluid jet that issues from said inlet port into said switching chamber and alternately switches its flow direction between said container and exhaust passages, said action serving to generate controllable pressure waves in said exhaust passage and expansion chamber, with said pressure waves acting to control the pattern of said fluid jet that flows from said orifice.

3. A fluidic oscillator as recited in claim 1, wherein said exhaust and container passages having tapered sidewalls which converge toward said inlet port.

4. A fluidic oscillator as recited in claim 2, wherein said exhaust and container passages having tapered sidewalls which converge toward said inlet port.

5. A fluidic oscillator as recited in claim 1, wherein said orifice is a sharp-edged orifice.

6. A fluidic oscillator as recited in claim 2, wherein said orifice is a sharp-edged orifice.

7. A fluidic oscillator as recited in claim 1, wherein said orifice is an annular orifice.

8. A fluidic oscillator as recited in claim 2, wherein said orifice is an annular orifice.

9. A fluidic oscillator as recited in claim 2 further characterized by selecting the dimensions of said expansion chamber so as to further control the pattern of said fluid jet that flows from said orifice.

10. A fluidic oscillator as recited in claim 4 further characterized by selecting the dimensions of said expansion chamber so as to further control the pattern of said fluid jet that flows from said orifice.

11. A fluidic oscillator as recited in claim 6 further characterized by selecting the dimensions of said expansion chamber so as to further control the pattern of said fluid jet that flows from said orifice.

12. A fluidic oscillator as recited in claim 8 further characterized by selecting the dimensions of said expansion chamber so as to further control the pattern of said fluid jet that flows from said orifice.

13. A method of providing a free fluid jet from fluid under pressure, said jet having distinctive, controllable and useful flow patterns, said method comprising the steps of:

forming a contained fluid jet, deflecting said contained jet between an exhaust passage and a container passage, wherein said exhaust passage having at its distal end an expansion chamber, said chamber having and an orifice that allows said fluid to flow from said chamber, and wherein the distal end of said container passage having a container, with said container and its contents working together to provide said distal end with specified compliance capabilities, generating controlled pressure waves in said exhaust passage and expansion chamber as a result of said contained jet deflections, with said pressure waves acting to control the pattern of said free fluid jet that flows from said orifice.

14. A method as recited in claim 13, further comprising the step of selecting the dimensions of said expansion chamber so as to further control the pattern of said fluid jet that flows from said orifice.

15. A method as recited in claim 14 wherein the geometry of said orifice is chosen so that said orifice has sharp edges.

16. A method as recited in claim 15 wherein the geometry of said orifice is chosen so that said orifice is an annular orifice.

17. A fluidic device capable of generating fluid jets having distinctive, controllable and useful flow patterns, said device comprising:

a means adapted to receive fluid under pressure and form a fluid jet, a means powered solely by the fluid under pressure for deflecting said jet between an exhaust and a contained passage, wherein said device being sized and operated at appropriate fluid pressure levels so as to generate controllable pressure waves in said exhaust passage, with said pressure waves acting to control the pattern of said fluid that flows from said exhaust passage.

18. A fluidic device as recited in claim 17, wherein the distal end of said exhaust passage having an expansion chamber and an orifice that allows said fluid to flow from said device, and wherein the distal end of said contained passage having a container, with said container and its contents working together to provide said distal end with specified compliance capabilities.

19. A fluidic device as recited in claim 18 further characterized by selecting the dimensions of said expansion chamber so as to further control the pattern of said fluid jet that flows from said device.

20. A fluidic device as recited in claim 19, wherein said orifice is a sharp-edged orifice.

21. A fluidic device as recited in claim 19, wherein said orifice is an annular orifice.

* * * * *